US007686650B2

(12) United States Patent
Belopolsky et al.

(10) Patent No.: US 7,686,650 B2
(45) Date of Patent: Mar. 30, 2010

(54) HIGH SPEED MODULAR JACK WITH FLEXIBLE COMPENSATION CIRCUIT

(75) Inventors: Yakov Belopolsky, Harrisburg, PA (US); David Blankenship, York, PA (US); David Gutter, Felton, PA (US); Richard Marowsky, York, PA (US)

(73) Assignee: Bel Fuse Ltd., San Po Kong, Kowloon (HK)

( * ) Notice: Subject to any disclaimer, the term of this patent is extended or adjusted under 35 U.S.C. 154(b) by 0 days.

(21) Appl. No.: 11/748,709

(22) Filed: May 15, 2007

(65) Prior Publication Data

US 2007/0270042 A1 Nov. 22, 2007

Related U.S. Application Data

(60) Provisional application No. 60/747,534, filed on May 17, 2006.

(51) Int. Cl.
*H01R 13/68* (2006.01)

(52) U.S. Cl. ..... 439/620.17; 439/620.14; 439/941

(58) Field of Classification Search ..... 439/676, 439/941, 620.09–620.14, 620.21–620.25
See application file for complete search history.

(56) References Cited

U.S. PATENT DOCUMENTS 6,702,618 B1 * 3/2004 Hyland et al. ..... 439/620.23
7,153,168 B2 12/2006 Caveney et al.
7,252,554 B2 * 8/2007 Caveney et al. ..... 439/676
7,281,957 B2 10/2007 Caveney

* cited by examiner

*Primary Examiner*—Felix O Figueroa
(74) *Attorney, Agent, or Firm*—Cozen O'Connor

(57) ABSTRACT

A jack capable of handling both Category 6 and Category 7 speed communications. The jack includes a shield, a housing disposed in the shield and a contact block disposed in the housing. The contact block includes a base member and a plurality of contacts carried by the base member. Each contact includes a contact portion effective to touch a corresponding contact of a plug when the plug is inserted into the jack, a first end portion effective to be inserted into a circuit board, and a second end portion. A flexible substrate is connected to the second end portion, the substrate including a compensation circuit for the jack.

21 Claims, 42 Drawing Sheets

| LETTER | MAXIMUM mm | MINIMUM mm | NOMINAL mm |
|---|---|---|---|
| A1 | | 1,47 | |
| B1 | 0,71 | | |
| K1[a] | 5,84 | | |
| S1 | 12,04 | 11,84 | 11,94 |
| T1 | 4,19 | 3,94 | |
| W1 | 6,38 | 6,22 | |
| X1 | 6,86 | 6,68 | |
| Y1 | | 2,34 | |
| AA1[b] | 1,24 | | |
| AB1 | 0,38 | | |
| AC1 | 6,96 | 6,76 | 6,86 |
| AD1 | 0,13 | | |
| AH1[g] | | | 1.02 |

| LETTER | MAXIMUM mm | MINIMUM mm | NOMINAL mm |
|---|---|---|---|
| A1 | | 1,47 | |
| B1 | 0,71 | | |
| K1[a] | 5,84 | | |
| S1 | 12,04 | 11,84 | 11,94 |
| T1 | 4,19 | 3,94 | |
| W1 | 6,38 | 6,22 | |
| X1 | 6,86 | 6,68 | |
| Y1 | | 2,34 | |
| AA1[b] | 1,24 | | |
| AB1 | 0,38 | | |
| AC1 | 6,96 | 6,76 | 6,86 |
| AD1 | 0,13 | | |
| AH1[g] | | | 1.02 |
| AK1 | 8,66 | 8,38 | |
| AL1[c] | | 1,40 | |
| AP1[f] | | 1,27 | |
| CA1 | 2,30 | 2,20 | |
| CG1 | 0,10 | | |
| CK1[a] | | 0,65 | |
| CN1 | 1,40 | 1,30 | |
| CP1 | 5,05 | 4,95 | |

FIG. 17

| LETTER | MAXIMUM mm | MINIMUM mm | NOMINAL mm |
|---|---|---|---|
| CQ1 | 6,00 | 5,80 | |
| CS1 | | | 7,66 |
| CT1 | 13,0 | 12,9 | |
| SA1 | | 5,31 | |
| SB1 | | 2,16 | |
| SD1 | 4,90 | | |
| SE1[d] | 5,80 | | |
| SG1[e,f] | 5,80 | | |
| LETTER | | | |
| AJ1 ANGLE | | | 15° |
| | | | |

NOTES

A. K1, CK1: CONTACT ZONE. CONTACTS SHALL BE COMPLETELY WITHIN THEIR INDIVIDUAL CONTACT ZONE IN THE AREA INDICATED.

B. AA1: PREFERRED MALE FREE CONNECTOR STOP

C. AL1: FRONT SURFACE NEED NOT BE PLANAR OR COINCIDENT WITH THE SURFACE BELOW THE LOCKING DEVICE AS LONG AS INSERTION, LATCHING AND UNLATCHING OF FREE CONNECTORS IS NOT INHIBITED. PROJECTIONS BEYOND AL1 DIMENSION SHALL NOT PREVENT FINGER ACCESS TO THE FREE CONNECTOR LOCKING (COUPLING) DEVICE.

D. SE1: MAXIMUM FORWARD EXTENSION OF CONTACTS BELOW SURFACE AC1, TO AVOID CONTACT WITH SHIELDS OF FREE CONNECTORS. APPLIES IN THE MATED STATE.

E. SG1: MAXIMUM FORWARD EXTENSION OF CONTACTS BELOW SURFACE REFERENCE PLANE B, TO AVOID CONTACT WITH SHIELDS OF FREE CONNECTORS. APPLIES IN THE MATED STATE.

F. SG1: WHEN THIS DIMENSION IS GREATER THAN 2.5 MM, AND THE FIXED CONNECTOR IS MATED WITH A IEC 60603-7-1,2,3,4,5 FREE CONNECTOR, SWITCH OPTION 2 SHOULD BE UTILIZED, TO MAINTAIN THE CLEARANCE REQUIREMENT BETWEEN SIGNAL CONDUCTORS 6',3',4',5' OF THE FIXED CONNECTOR AND THE SCREEN OF THIS FREE CONNECTOR. NOTE THAT SG1 IS 0.0 MM IN THE MATED STATE WITH THIS IEC 60603-7-1,2,3,4,5 FREE CONNECTOR.

G. AP1: FLAT SURFACE

H. AH1: TRUE POSITION

FIG. 18

ELECTRICAL CHARACTERISTICS @ 25°C

| | |
|---|---|
| TURNS RATIO: (P7-P6) : (J4-J5) | : 1 : 1 ±2% |
| (P11-P10) : (J3-J6) | : 1 : 1 ±2% |
| (P3-P2) : (J7-J8) | : 1 : 1 ±2% |
| (P15-P14) : (J1-J2) | : 1 : 1 ±2% |
| DCL @ 100kHz,100m VRMS 8mA DC BIAS | |
| (P3-P2) ; (P7-P6); (P11-P10) ; (P15-P14) | : 350 uH MIN |
| LEAKAGE INDUCTANCE: | |
| P3-P2 (WITH J7 AND J8 SHORT) | : 20nH Max. @ 1MHz |
| P7-P6 (WITH J4 AND J5 SHORT) | : 20nH Max. @ 1MHz |
| P11-P10 (WITH J3 AND J6 SHORT) | : 20nH Max. @ 1MHz |
| P15-P14 (WITH J1 AND J2 SHORT) | : 20nH Max. @ 1MHz |
| INTERWINDING CAPACITANCE: | |
| (P3-P2) : (J7-J8) | : 5pf MAX @ 1MHz |
| (P11-P10) : (J3-J6) | : 5pf MAX @ 1MHz |
| (P7-P6) : (J4-J5) | : 5pf MAX @ 1MHz |
| (P15-P14) : (J1-J2) | : 5pf MAX @ 1MHz |
| DC RESISTANCE: | |
| (J6-J3) ; (J2-J1) ; (J7-J8) ; (J4-J5) | : 1.2 ohms MAX |
| RETURN LOSS: (RS=RL=100 ohms) | |
| 1MHz TO 30MHz | : -19dB MIN |
| 30MHz TO 60MHz | : -13dB MIN |
| 60MHz TO 80MHz | : -12dB MIN |
| 80MHz TO 300MHz | : -10dB MIN |
| DIELECTIRC WITHSTAND: | |
| (J1,J2) TO (P15,P14) ; (J4,J5) TO (P7-P6) | : 1500 VAC |
| (J3,J6) TO (P11,P10) ; (J7,J8) TO (P3,P2) | : 1500 VAC |
| INSERTION LOSS: | |
| 100KHz TO 300MHz | : -1.1 dB TYP |
| 300MHz TO 400MHz | : -1.5 dB TYP |
| CROSS TALK: | |
| 1-100 MHz | : -35dB MIN |
| COMMON TO COMMON MODE ATTENTUATION: | |
| 1MHz TO 500MHz | : TBD |
| DIFFERENTIAL TO COMMON MODE ATTENTUATION: | |
| 1MHz TO 500MHz | : TBD |

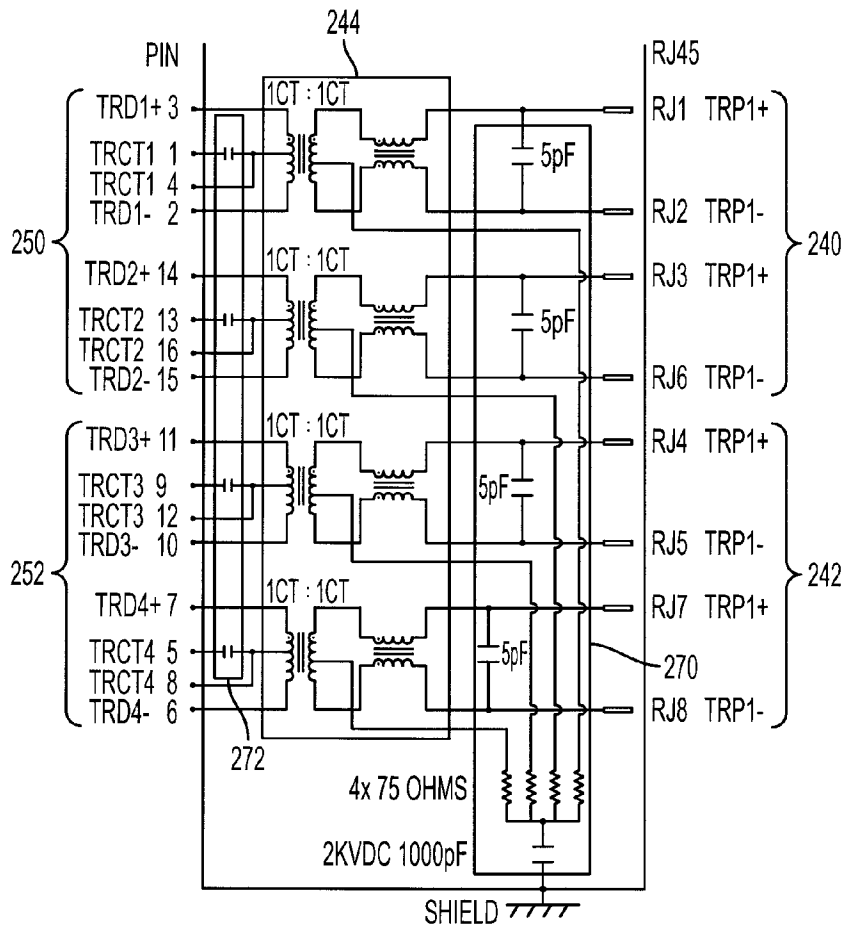

FIG. 22

HIGH SPEED MODULAR JACK WITH FLEXIBLE COMPENSATION CIRCUIT

This application claims priority to provisional application No. 60/747,534 entitled "HIGH SPEED MODULAR JACK" filed May 17, 2006, the entirety of which is hereby incorporated by reference.

BACKGROUND OF THE INVENTION

The invention relates to a modular jack and, more particularly, to a modular jack which may be compliant with multiple communication standards and/or which includes improved noise compensation abilities.

The use of modular plugs and jacks for data transmission is known. Basically, in order to establish electrical communication and a data path between a first and second device, the first device may send information in the form of electrical signals out into a cable that terminates in a plug. The second device may include a jack. The plug and jack are designed so as to be easily mechanically mate-able in a male-female configuration. Once the plug and jack are mated, electrical members in the plug and connector engage and are electrically mated so that electrical information signals may travel from the first device to the second device.

This plug and jack design is limited by the physical configuration of the modular plug and jack. As data transmission speeds have increased, electrical performance relating to the transfer of electrical signals from plug to connector, has been affected. Each plug and jack frequently includes multiple pairs of contacts used to communicate information. Cross talk between these pairs (where electrical signals in one pair affect electrical signals in another pair) and interference from sources external to the plug-jack configuration, become more of a factor at higher speeds. In order to carry the higher speed data without signal degradation, the plug and connector design changed to include compensation circuitry such as that used to balanced impedance in transmission lines.

Standards organizations such as the Telecommunication Industry Association and the International Organization for Standardization publish standards regarding performance specifications and equipment configurations for plugs and connectors. Different levels or "categories" have been defined for use in twisted-pair cabling such as where a single insulated sheath includes two twisted wires. For example, "Category 6" jacks should be able to handle data communications with a frequency up to 250 MHz. More recent requirements, e.g. Category 7, require jacks which can communicate as high as 600 MHz.

Prior art Category 6 jacks typically employ the compensation circuit near terminals in the jack. That is, a plug having contacts mates with a jack having contacts so that the contacts in the plug physically touch and electrically engage with the contacts in the jack. The electrical signals sent from the contacts of the plug to the contacts of the jack travel through the contact portions of the contacts of the jack to terminals portion of the contacts of the jack and then those terminal portions are connected to a circuit board. The compensation circuit in these prior art Category 6 jacks is typically disposed near the terminal portions. For example, information signals may travel through the terminal portions through the compensation circuit and then to the circuit board. The inventors of the present invention have performed research and learned of the surprising discovery that movement of the compensation circuit to a different location yields significantly better electrical characteristics as is discussed in more detail below.

An example of a prior art jack which may be used for both Category 6 and Category 7 communications is shown in U.S. Pat. No. 6,739,892 and is reproduced in part, in FIG. 1. Referring to FIG. 1, a prior art connector 50 consists of a shield 52, a dielectric housing 54, a switch insert 56 and a circuit board sub-assembly 58. When assembled, sub-assembly 58 is inserted into switch insert 56, switch insert 56 is inserted into housing 54, and housing 54 is inserted into shield 52. When a Category 6 plug is inserted into jack 50, terminals on sub-assembly 58 engage corresponding terminals of the plug for data communication. If a Category 7 plug is inserted into jack 50, a protrusion on the plug (not shown) engages a switch 60 on switch insert 56. Switch 60 causes some of the terminals in connector 50 to be lifted away from electrical connection and moved into contact with a grounding member (not shown).

There are problems with the prior art connector shown in FIG. 1. Requiring a switch to disengage or ground some of the terminals increases the complexity of the device. Moreover, there is the possibility of an open circuit especially if there is a failure in the switch. Finally, any compensation circuitry is disposed from terminal portions of the contacts.

SUMMARY OF THE INVENTION

One embodiment of the invention is a jack comprising a housing and a contact block in the housing, the contact block including a base member and a plurality of contacts carried by the base member, each contact including a contact portion effective to touch a corresponding contact of a plug when the plug is inserted into the jack, a first end portion effective to be attached to an electronic circuit, and a second end portion. The jack further comprises a substrate connected to the second end portion, the substrate including a compensation circuit for the jack.

Another embodiment of the invention is a jack comprising a housing and at least one contact in the housing, each contact including a contact portion effective to touch a corresponding contact of a plug when the plug is inserted into the jack, a first end portion effective to be attached to an electronic circuit, and a second end portion. The jack further comprises a substrate connected to the second end portion, the substrate including a compensation circuit for the jack.

BRIEF DESCRIPTION OF THE DRAWINGS

FIG. 17 is a chart detailing particular measurements which could be used in constructing an embodiment of the invention.

FIG. 18 is a chart detailing particular measurements which could be used in constructing an embodiment of the invention.

FIG. 22 is a circuit diagram along with tolerances for circuit elements which could be used in accordance with an embodiment of the invention.

DETAILED DESCRIPTION OF THE PREFERRED EMBODIMENT(S)

Figure 1:
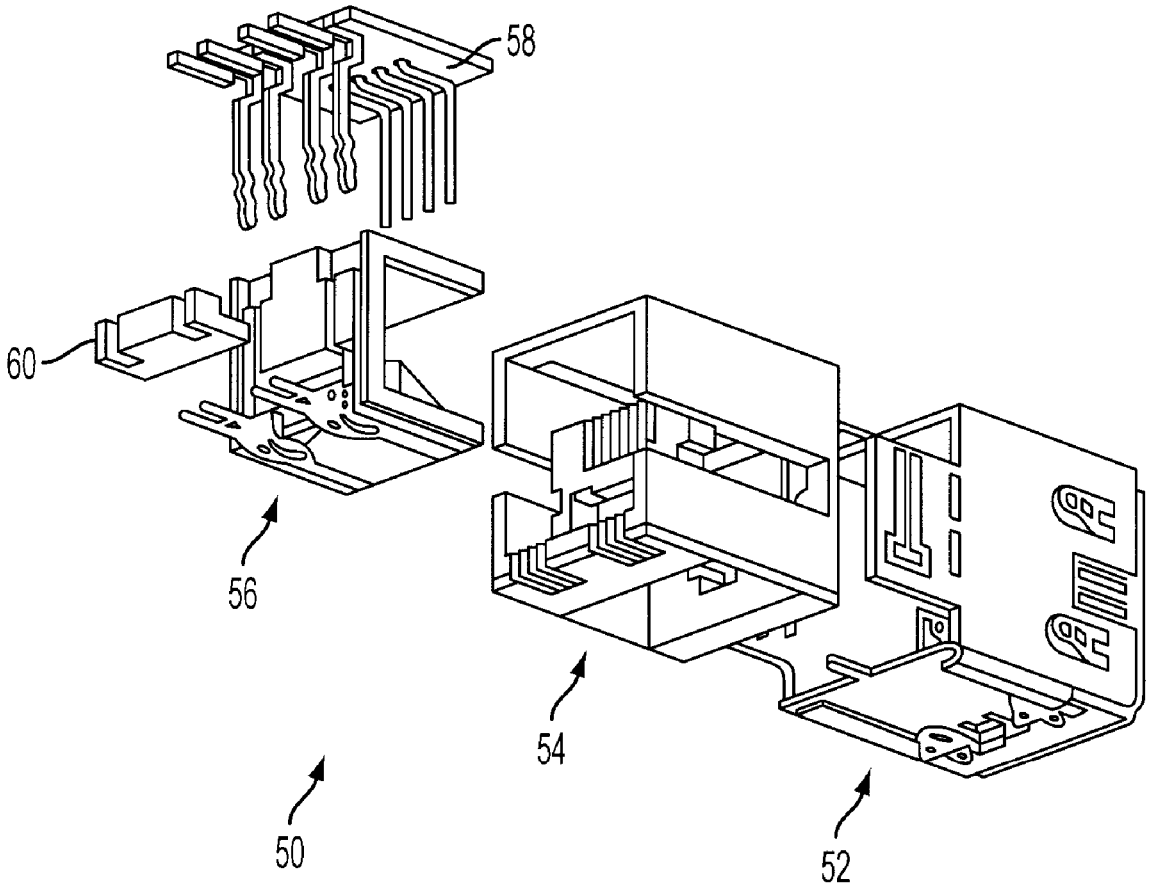
FIG. 1 PRIOR ART
FIG. 1 is a side perspective view of a jack in accordance with the prior art.
Figure 2:
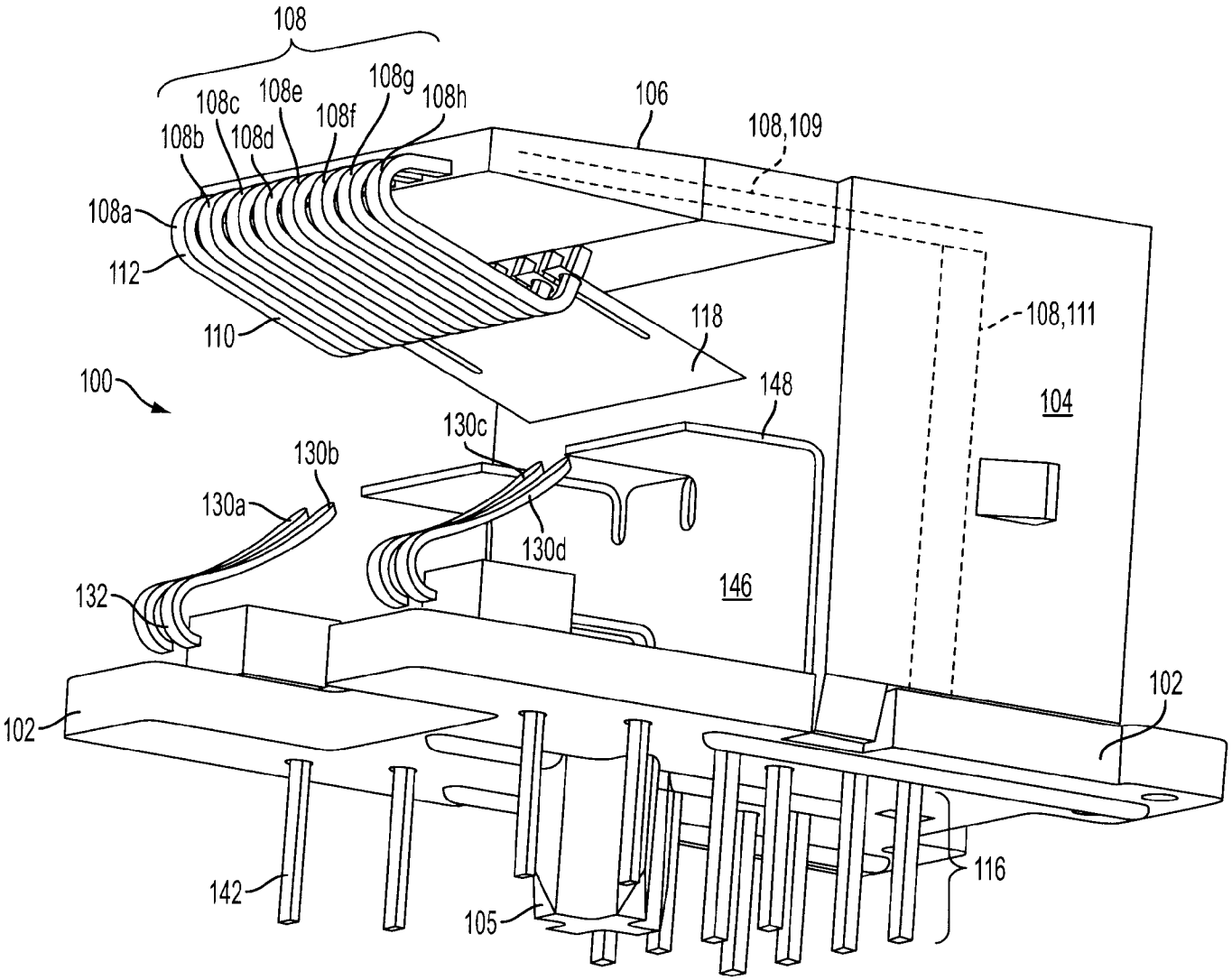
FIG. 2 is a side perspective cut-away view of a jack in accordance with an embodiment of the invention.

Referring to FIG. 2, there is shown a jack 100 in accordance with an embodiment of the invention with a portion of the housing removed. Jack 100 is capable of communicating with a plug (not shown) using Category 6, Category 6A, Category 7, Category 7A communication standards as well as other communication standards. Jack 100 includes a base 102 on which elements of jack 100 are mounted. A post 105 having a cross-shaped cross-section extends from a bottom of base 102 and may be used to mechanically mount jack 100 to a circuit board (not shown). Although shown on a bottom of jack 100, post 105 could be disposed on a top of jack 100 and used to mount jack 100 to a circuit board from either above, below, to the side or oblique to jack 100.

Figure 3:
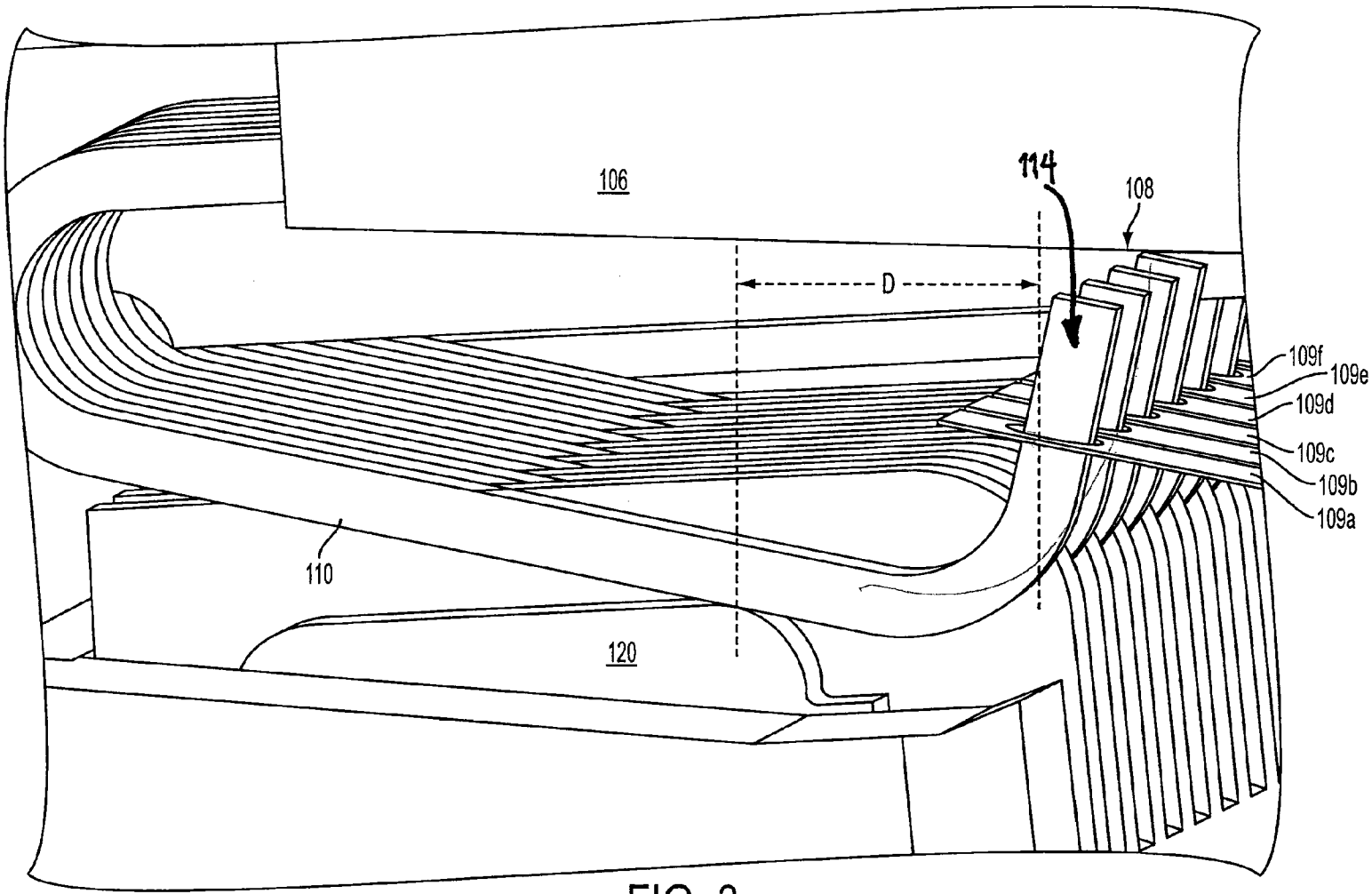
FIG. 3 is a magnified side perspective cut-away view of a combination plug and jack in accordance with an embodiment of the invention.

Jack 100 includes a pass-through housing 104 (which may include a removable cover having recesses) mounted on base 102. As discussed below, pass-through housing 104 may be used to provide a pathway for terminals to pass through to base 102. Housing 104 includes a cantilevered support 106. Support 106 supports upper contacts 108. As shown, eight (8) upper contacts 108*a*, 108*b*, 108*c*, 108*d*, 108*e*, 108*f*, and 108*g* may be used as is customary in RJ45 type connectors when communicating at Category 6 or 6A speeds and configurations. Upper contacts 108 include contact portions 110 which physically touch contacts of an inserted plug (partially shown in FIG. 3). Upper contacts 108 further include an arcuate connecting portion 112 fixed at one end to support 106. Elongate straight contact portions 110 extend downward into a plug-receiving area of jack 100 and terminate at second ends portions 114 constituted by bends in the end regions of the contact portions 110. Second end portions 114 are coupled to a flexible substrate 118 upon which a compensation circuit is provided. As best seen in FIG. 3, second end portions 114 form substantially right angles with the contact portions 110.

Upper contacts 108 further include bridge portions 109 that extend through the cantilevered support 106 (e.g. are insert molded therein), and vertical terminal portions 111 that extend through pass-through housing 104 and though base 102—both shown in dotted lines. Upper contacts 108 exit from base 102 to form pins 116 to provide electrical communication with a circuit board (not shown). Pins 116 exit base 102 in two planes as shown.

Flexible compensation circuitry 118 may be used to cancel out interference between neighboring pairs of contacts 108, reduce cross-talk between contacts 108, or to balance a cable terminating in jack 100. A circuit including capacitors electrically connecting neighboring contacts 108 may be used. For example, referring to contacts 108*a*-108*h* as first though eighth, respectively, between a third and a fifth contact 108, a capacitor with a value in a range of approximately 300 to 3600 fF could be used; between a fourth and a sixth contact 108, a capacitor with a value in a range of approximately 300 to 3600 fF could be used; between a first and a third contact 108, a capacitor with a value in a range of approximately 0 to 2400 fF could be used; between a second and a sixth contact 108, a capacitor with a value in a range of approximately 0 to 2100 fF could be used; between a third and a seventh contact 108, a capacitor with a value in a range of approximately 0 to 2100 fF could be used; between a sixth and an eighth contact 108, a capacitor with a value in a range of approximately 0 to 2400 fF could be used. Other arrangements and capacitance values are within the scope of the invention.

Referring to FIG. 3, there is shown an enlarged cut-away view of the connection between flexible compensation circuitry 118 and contacts 108. As shown, when a plug with a blade-like contact 120 is inserted into jack 100, plug blade 120 physically touches and communicates electrically with one of contacts 108. Openings are formed through the flexible substrate at an edge region thereof and the second end portions 114 of the contacts 108 pass through the openings to connect the flexible substrate to the contacts. Flexible compensation circuit 118 is soldered at circuit contacts 124 to the ends of contacts 108 and the flexible substrate is otherwise unsupported in the jack. The connection is designed to minimize the distance D between the point 126 of the plug-connector contact and the connection of the connector contact to the circuit 118 to minimize signal degradation.

Flexible compensation circuit 118 has a flexible substrate including a plurality of spaced fingers 109*a* . . . 109*h* (only 109*a* . . . 109*f* shown in the figure). The spacing of fingers 109 allows contacts 108 to move independently to accommodate variations in size of an inserted plug. If compensation circuit 118 were a solid member, contacts 108 may be required to move together to accommodate plug variations. When plug blades 120 engage the contact portions 110 of contacts 108 (thereby flexing contacts 108 around arcuate portions 112), respective fingers 109 of circuit substrate 118 will also flex and/or move to allow for such insertion but still remain connected to contacts 108.

Referring again to FIG. 2, jack 100 may be used to provide electrical connection with a plug using Category 6 communication. Upper contacts 108 enable such communications. Jack 100 further allows for communication using Category 7 speeds and corresponding plugs. Such plugs have blade-like contacts disposed on both a top and a bottom of the plug. To accommodate such plugs, jack 100 includes bottom contacts 130 on a side of jack 100 opposite contacts 108. As shown, four bottom contacts 130*a*, 130*b*, 130*c*, and 130*d*, are arranged in two pairs on a bottom of jack 100 on a side opposite upper contacts 108.

Each bottom contact 130 includes a base portion 132 fixedly mounted to a mounting member 134. For simplicity, explanation will be made with respect to bottom contact 130*a* though it should be clear that all bottom contacts 130 are similarly structured. As shown most clearly in FIG. 4 (where base 102 has been removed for clarity), mounting member 134 has a downwardly extending cylindrical shaped projection 136. Projection 136 may be used to mate with a corresponding recess in base 102. Bottom contacts 130 further include an arcuate portion 138 and terminate at a first contact portion 140. First contact portion 140 is spring biased upwardly at arcuate portion 138 so as to enhance electrical and mechanical communication with an inserted plug. Bottom contacts 130 have vertical portions which project through the base 102 (FIG. 3) to form pins 142 which communicate with a circuit board (not shown). Pins 142 exit base 102 in two planes as shown.

Figure 4:
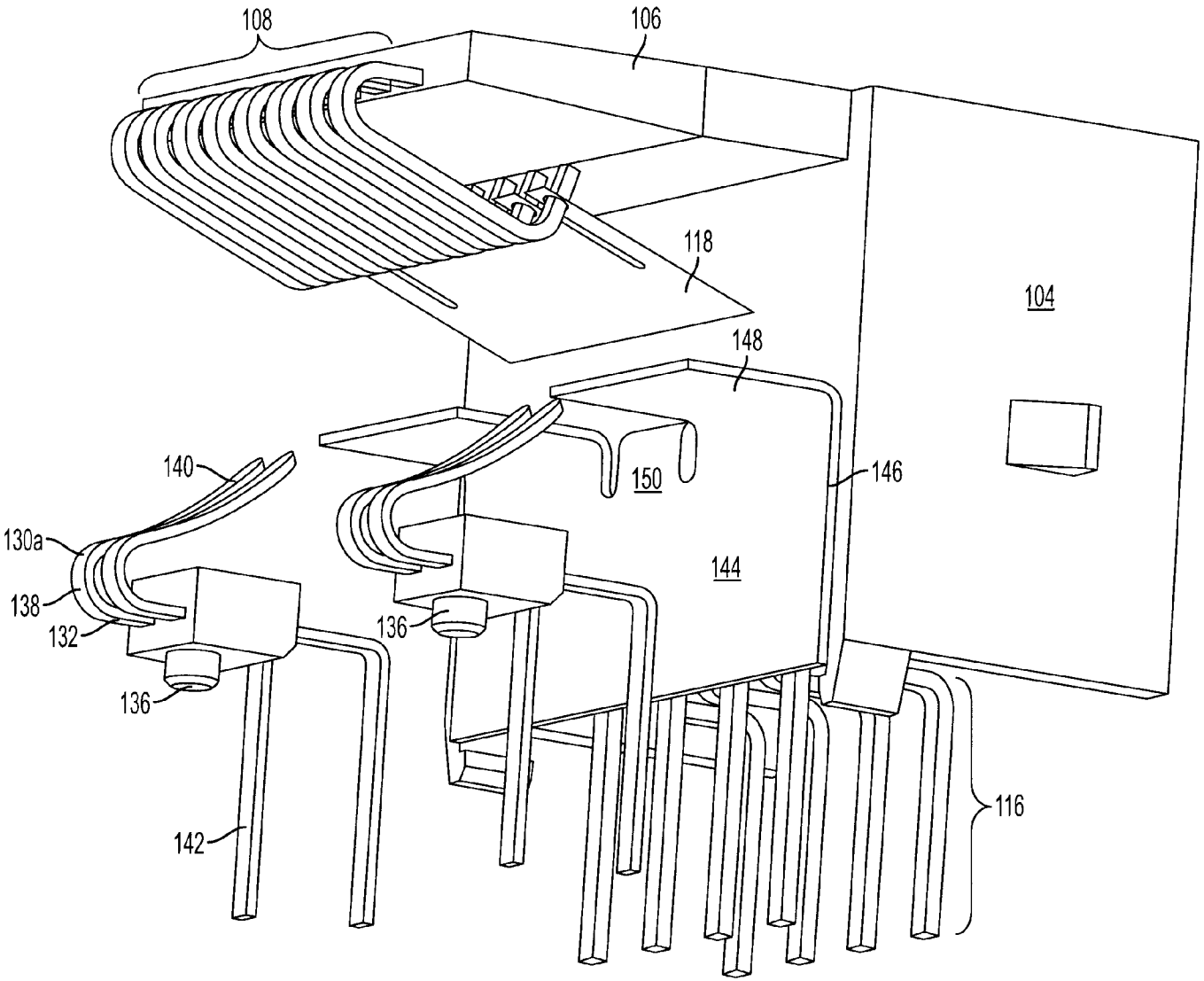
FIG. 4 is a side perspective cut-away view of a jack in accordance with an embodiment of the invention.
Figure 5:
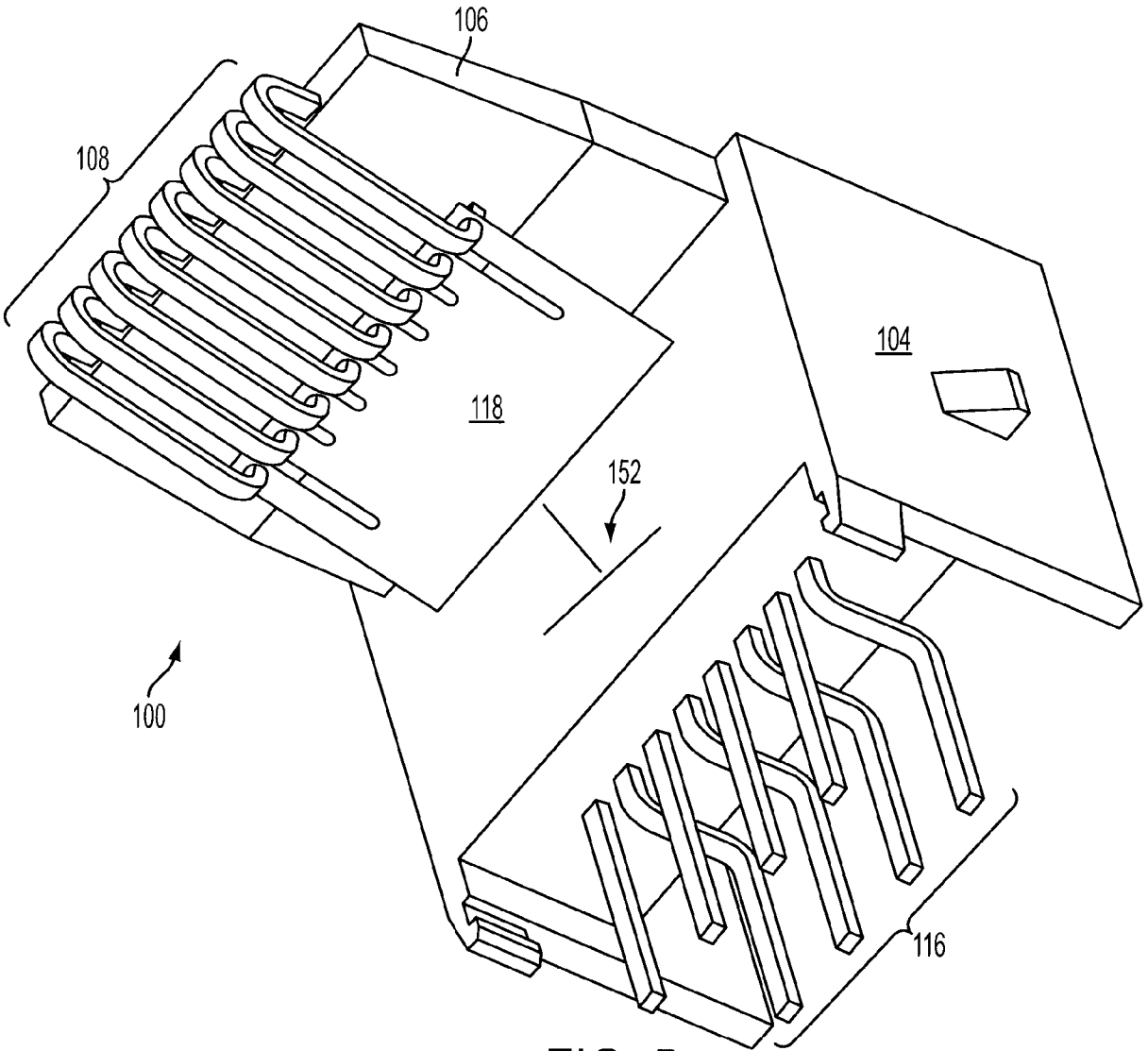
FIG. 5 is a bottom perspective cut-away view of a jack in accordance with an embodiment of the invention.

Referring to both FIGS. 2 and 4, an L-shaped shield 144 made of a metallic material is mounted to housing 104. Shield 144 includes a base portion 146 extending parallel to the pins 116 of upper contacts 108 and to pins 142 of lower contacts 130. Shield 144 further includes a flange 148 extending perpendicular to base 146. Shield 144 includes a tab 150 extending parallel to flange 148 but in an opposite direction from flange 148. Tab 150 may be used to mount shield 144 to housing 104 through a T-shaped recess 152 shown in FIG. 5.

Shield 144 provides desirable shielding for connector 100 when used with Category 7 communications. Base 146 of shield 144 provides shielding between bottom contacts 130 and the vertical portions 111 of top contacts 108 that extend through through-housing 104. Further, flange 148 provides shielding between bottom contacts 130 and top contacts 108 in an area where a plug is inserted into connector 100.

Figure 6:
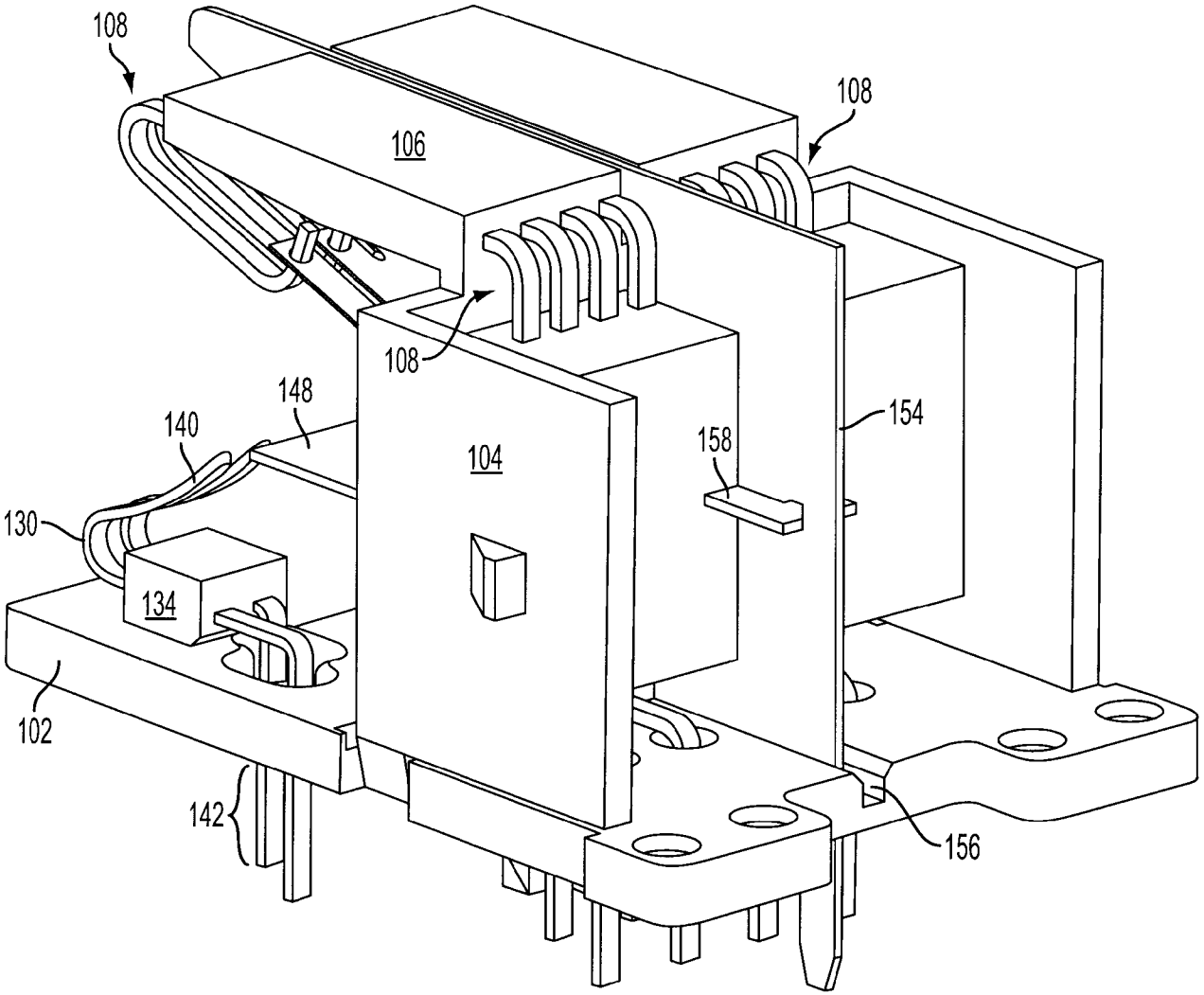
FIG. 6 is a rear perspective cut-away view of a jack in accordance with an embodiment of the invention.
Figure 7:
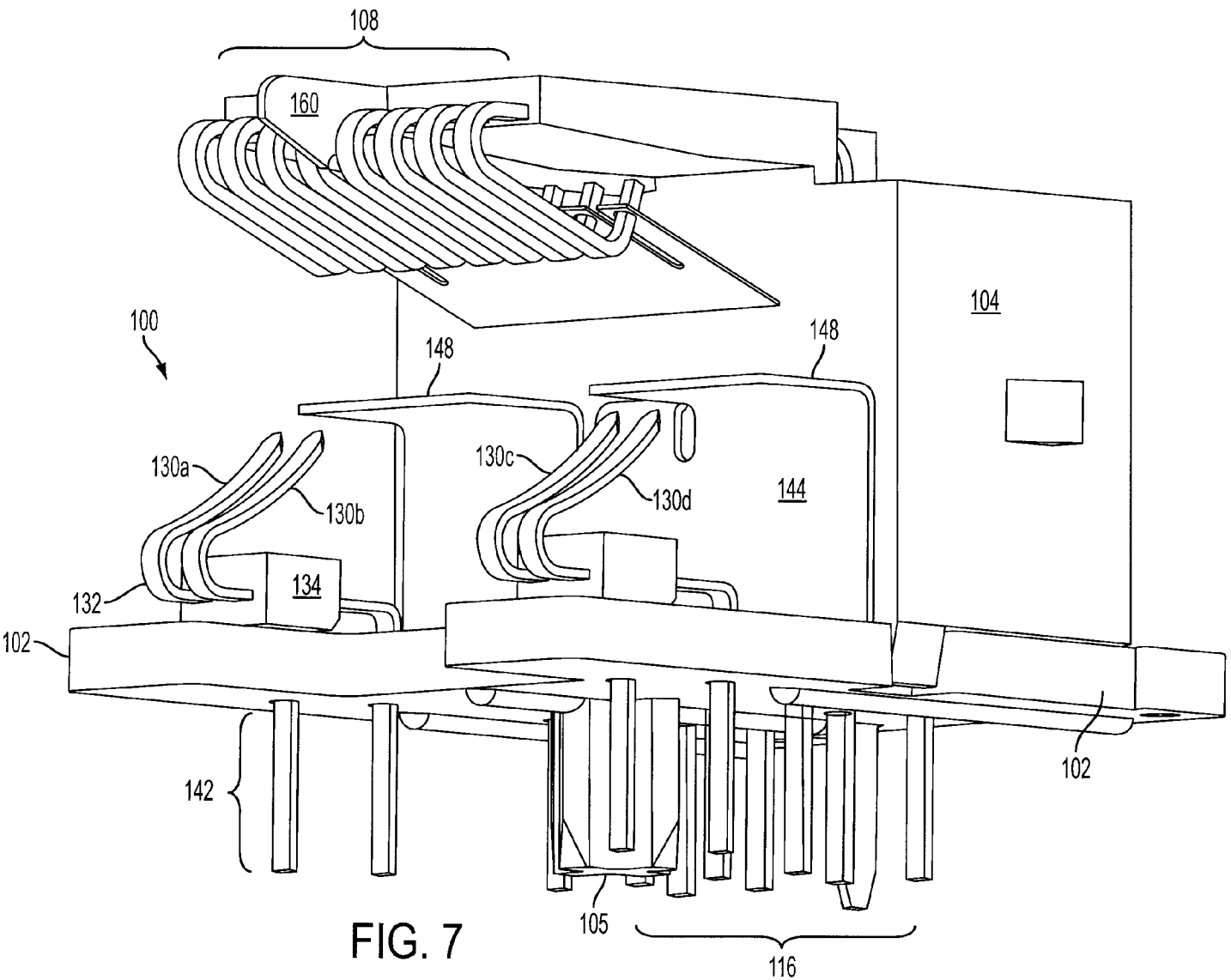
FIG. 7 is a side perspective cut-away view of a jack in accordance with an embodiment of the invention.

When using Category 7 communications, laterally disposed pairs of upper contacts 108*a*, 108*b*, 108*g* and 108*h* are used. Referring to FIG. 6, to further shield signal pairs in these upper contacts from each other, a vertical shield 154 may be used to shield communications between upper contacts 108*a*, 108*b* and contacts 108*g*, 108*h* (contacts shown most clearly in FIG. 2) as the vertically extending contact portions 110 (FIG. 2) of these contacts extend on either sides of shield 154. Of upper contacts 108, only contacts 108*a*, 108*b*, 108*g* and 108*h* are used for Category 7 communications. The vertical shield 154 may be made of a metallic material and may be mounted in a rear of housing 104 in a recess 156 and in a support 158. Referring also to FIG. 7, an additional vertical shield 160 may be mounted on support 106 between upper contacts 108*d* and 108*e*. Again, shield 160 is made of a metallic material and serves to shield upper contacts 108*a*, 108*b* from upper contact 108*g*, 108*h* when Category 7 communications are used. As discussed, when Category 7 communications and plugs are used, shields 144, 154 and 160 may be used to shield communication between respective upper and lower contacts 108, 130.

Figure 8:
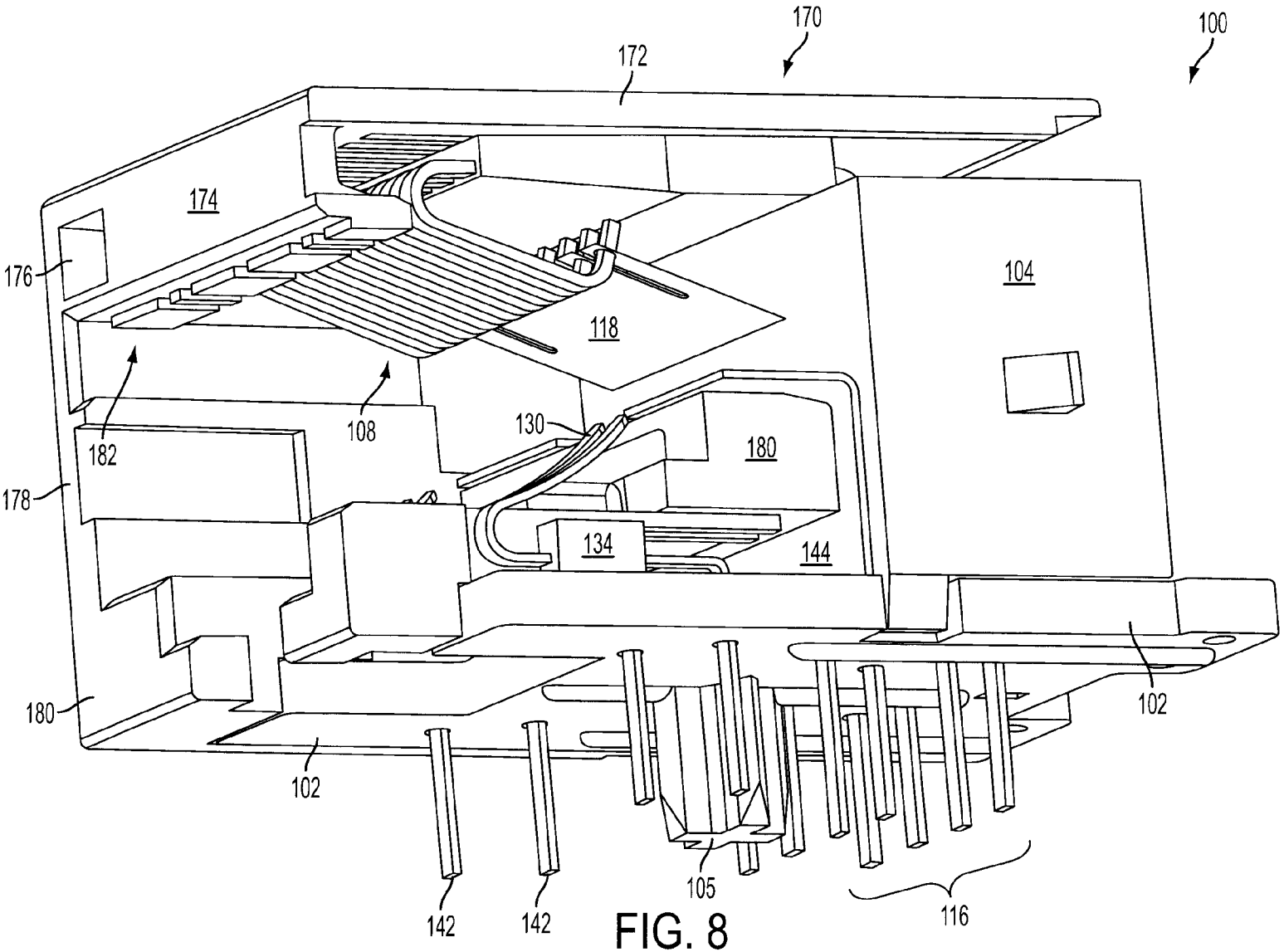
FIG. 8 is a side perspective cut-away view of a jack in accordance with an embodiment of the invention.

Now that the arrangement of the contacts for connecting the jack with a plug and the shielding of these contacts has been described, the housing and external shielding of jack 100 will be explained. Referring now to FIG. 8, a housing 170 of connector 100 includes a top 172, a top front 174, a bottom front 180 and sides 178. Note that FIG. 8 is a cut-away view of housing 170 and only one side 178 is shown. Top front 174 includes cavities 176 for receiving optical light pipes discussed below. Top front 174 further includes a flat frame portion 182 used to help define an insertion area 184 for a plug (not shown) to be inserted. Bottom front 180 of housing 170 has a stepped cross-section typical for receiving modular plugs. Flat frame portion 182, in combination with sides 178 and bottom front 180 define a plug-receiving cavity 184. Cavity 184 is defined so as to be capable of receiving both Category 6 and Category 7 plugs.

Figure 9:
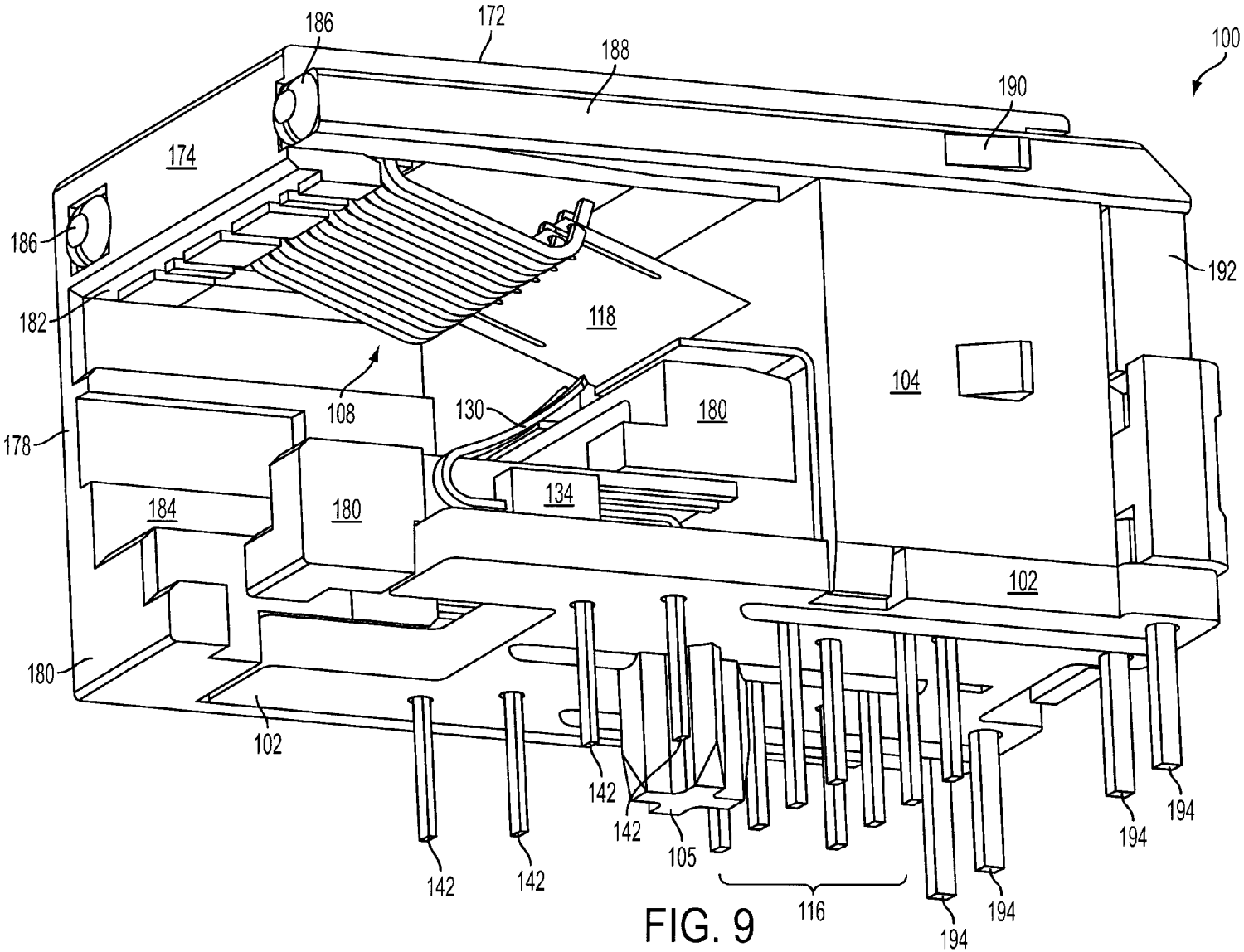
FIG. 9 is a side perspective cut-away view of a jack in accordance with an embodiment of the invention.

Referring to FIG. 9, more detail of housing 170 is shown including the provision of optical light pipes. As shown in the figure, optical light pipes 188 may be inserted into a longitudinal opening defined by housing 170. The openings terminate at ends of housing 170 and form cavities 176 defined by top front portion 174. Each optical light pipe 188 includes an exposed end 186 situated in a respective cavity 176. LEDs 192 are disposed at a rear of housing 170 and include LED terminals 194 extending downwardly. LEDs 192 are in optical communication with light pipes 192 so that light emitted from LEDs 192 may travel through light tubes 192 and be visible at ends 186. Such light may indicate that jack 100 is receiving power and/or indicate that jack 100 is receiving or transmitting information or simply connected to a plug. Light pipes 188 include outwardly biased flanges 190 used to connect light pipe 188 to housing 170. Flange 190 is discussed in more detail below. A rear support 193 is used to retain LEDs 192 and terminals 194 on housing 170 and to provide further structural support for housing 170.

Figure 10:
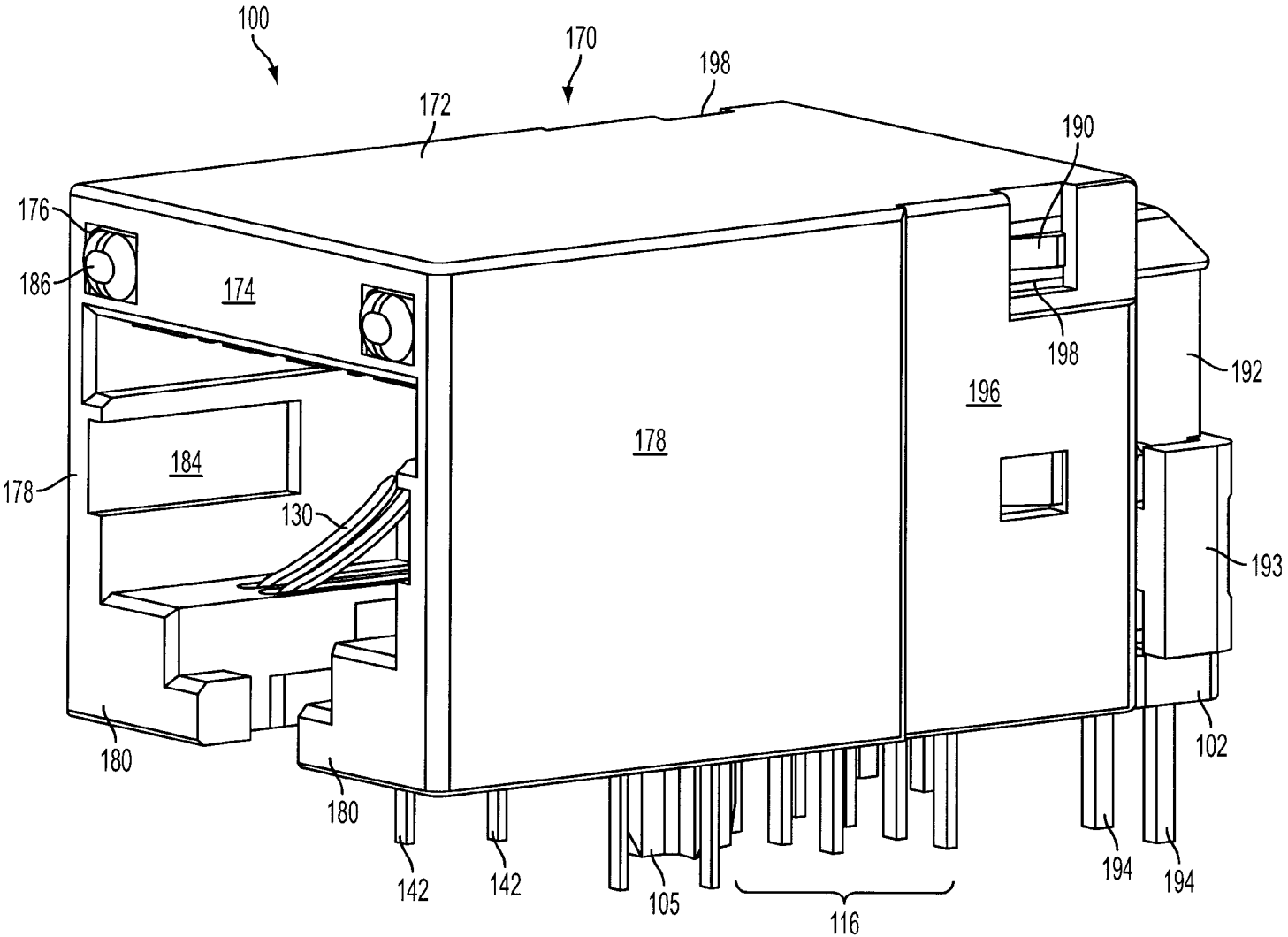
FIG. 10 is a side perspective view of a jack in accordance with an embodiment of the invention.
Figure 11:
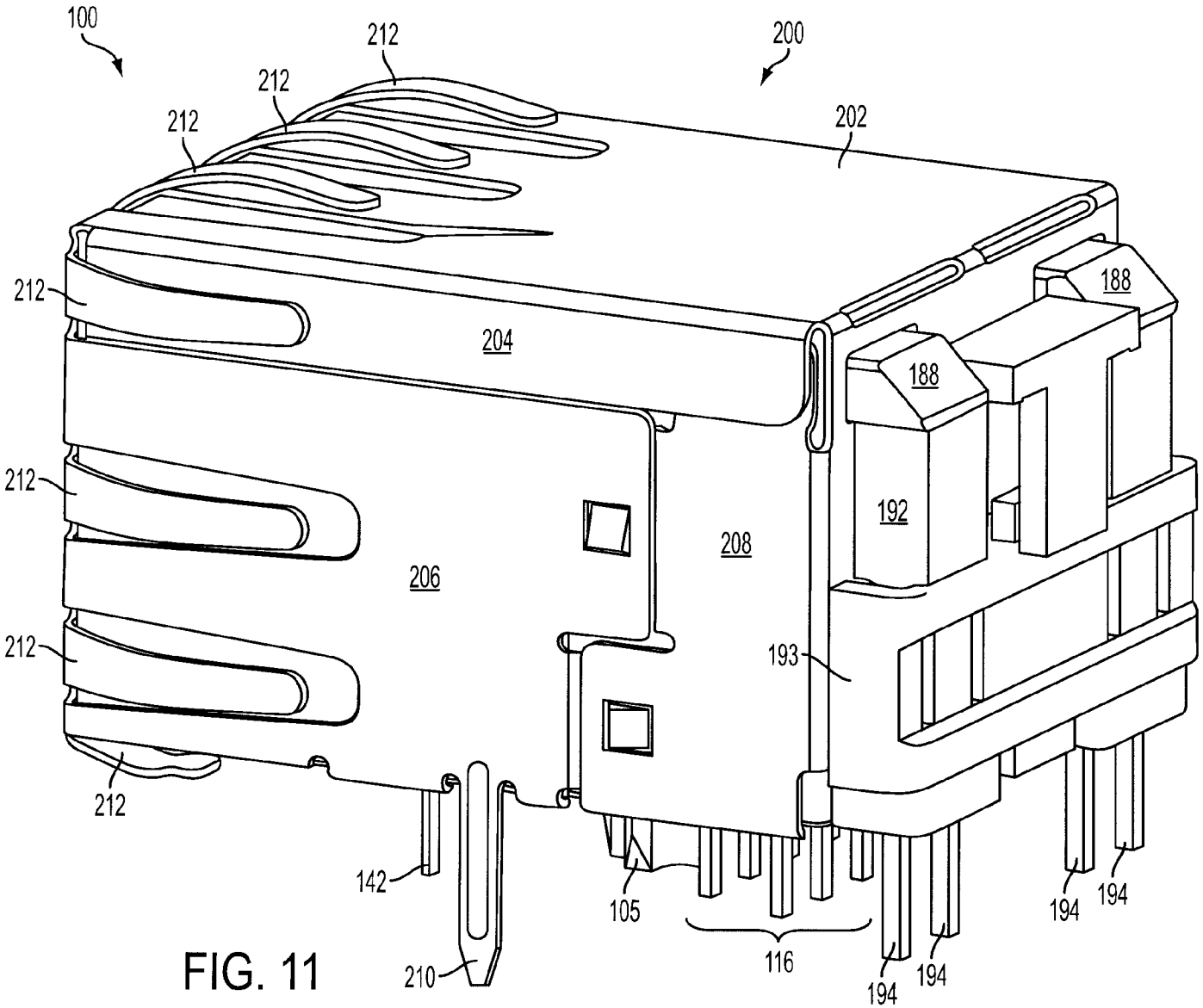
FIG. 11 is a side perspective view of a jack in accordance with an embodiment of the invention.
Figure 12:
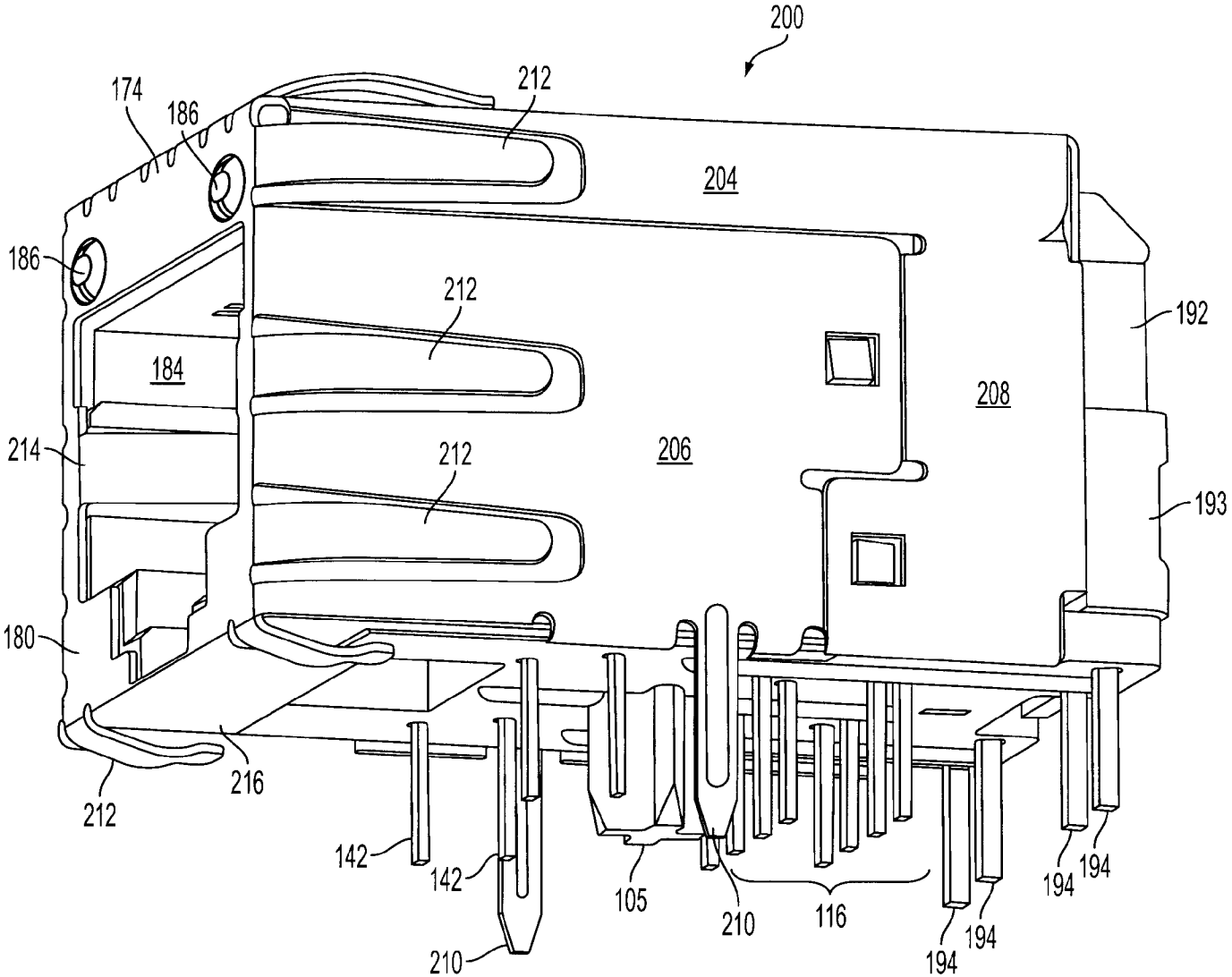
FIG. 12 is a side perspective view of a jack in accordance with an embodiment of the invention.

Referring to FIG. 10, there is shown a view of the entire housing 170. As shown, sides 178 of housing 170 further include rear portions 196. Rear portions 196 define openings 198 for receiving the flanges 190 of light tubes 188. In this way, light tubes 188 may be inserted from a rear of housing 170 toward front 174, 180 of housing. A user inserting tubes 188 into housing 170 causes outward biased flange 190 to bend inwardly. Once flange 190 of light tube 188 reaches opening 198, flange 190 again extends outwardly thereby maintaining tube 188 in housing 170. To replace tube 188, a user may push flange 190 inward and then push tube 188 to the rear of housing 170.

Referring to FIGS. 11-14, there is shown an external shield 200 which may be used with jack 100. Shield 200 includes a base including a top portion 202, lips 204 which extend from top 202 to sides of jack 100, side front portions 206, side rear portions 208, and a front face 218. Side front portions 206 terminate in ground connectors 210. Ground connectors 210 may be used to ground shield 200 to a circuit board. Shield 200 includes spring members 212 extending outward from top 202, sides 206, 208 and a bottom 216 of shield 200. Spring members 212 are effective to engage a grounding member (not shown) of a chassis (not shown) when jack 100 is inserted into the chassis.

Figure 13:
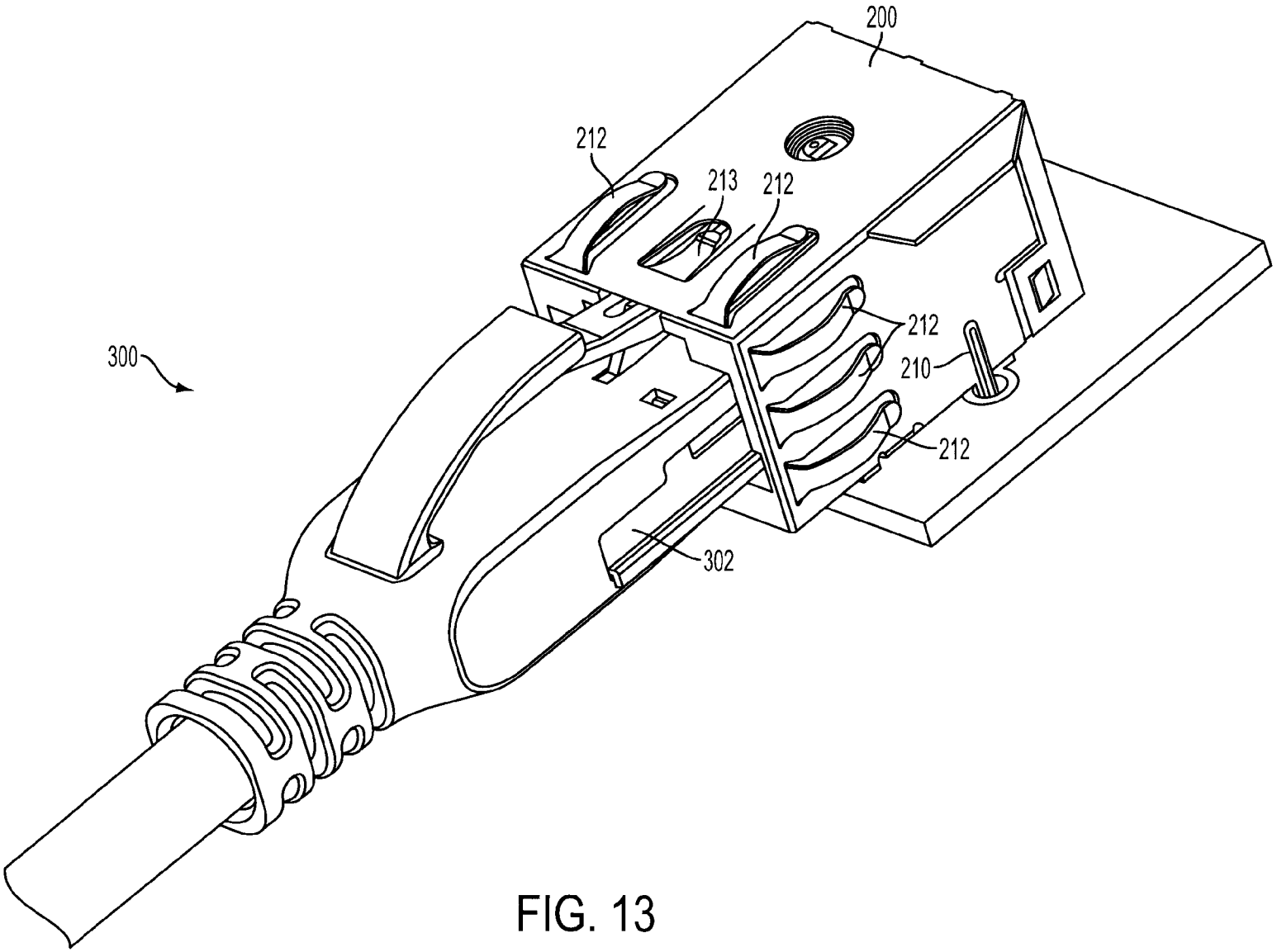
FIG. 13 is a front perspective view of a plug combined with a jack in accordance with an embodiment of the invention.
Figure 14:
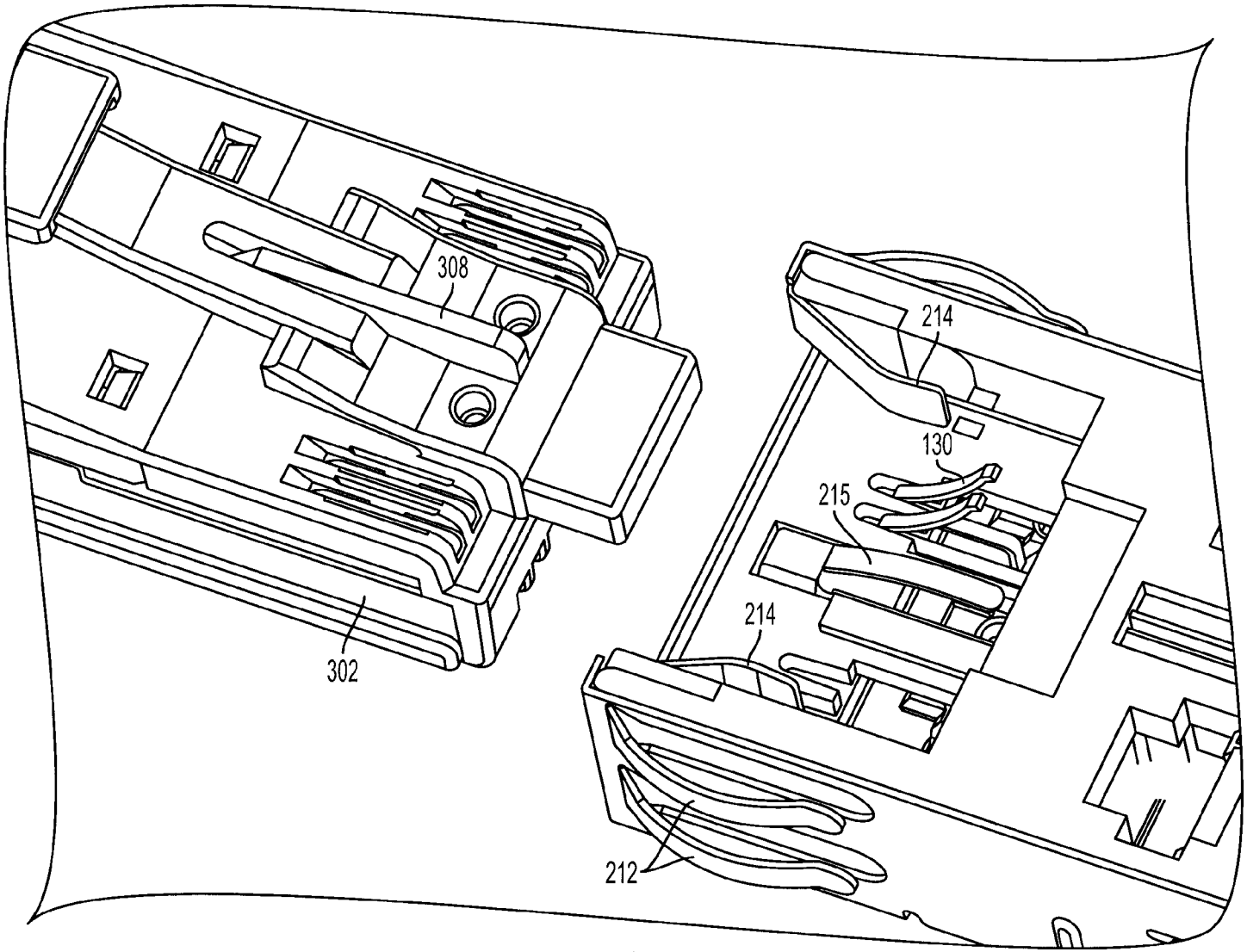
FIG. 14 is a top perspective view of a plug combined with a jack in accordance with an embodiment of the invention.

Focusing on FIGS. 13 and 14, there is shown a plug 300 mating with jack 100. These figures highlight how shield 200 of jack 100 provides grounding for an inserted plug. A top spring 213 (FIG. 13) of shield 200 touches a point 308 (FIG. 14) of shield 302 of plug 300. Further, spring member 214 of shield 200 touch sides of shield 302 of plug 300. Finally, a bottom spring 215 of shield 200 touches a bottom of shield 200. In this way, shield 302 of plug 300 is brought to the same potential as shield 200.

Figure 15:
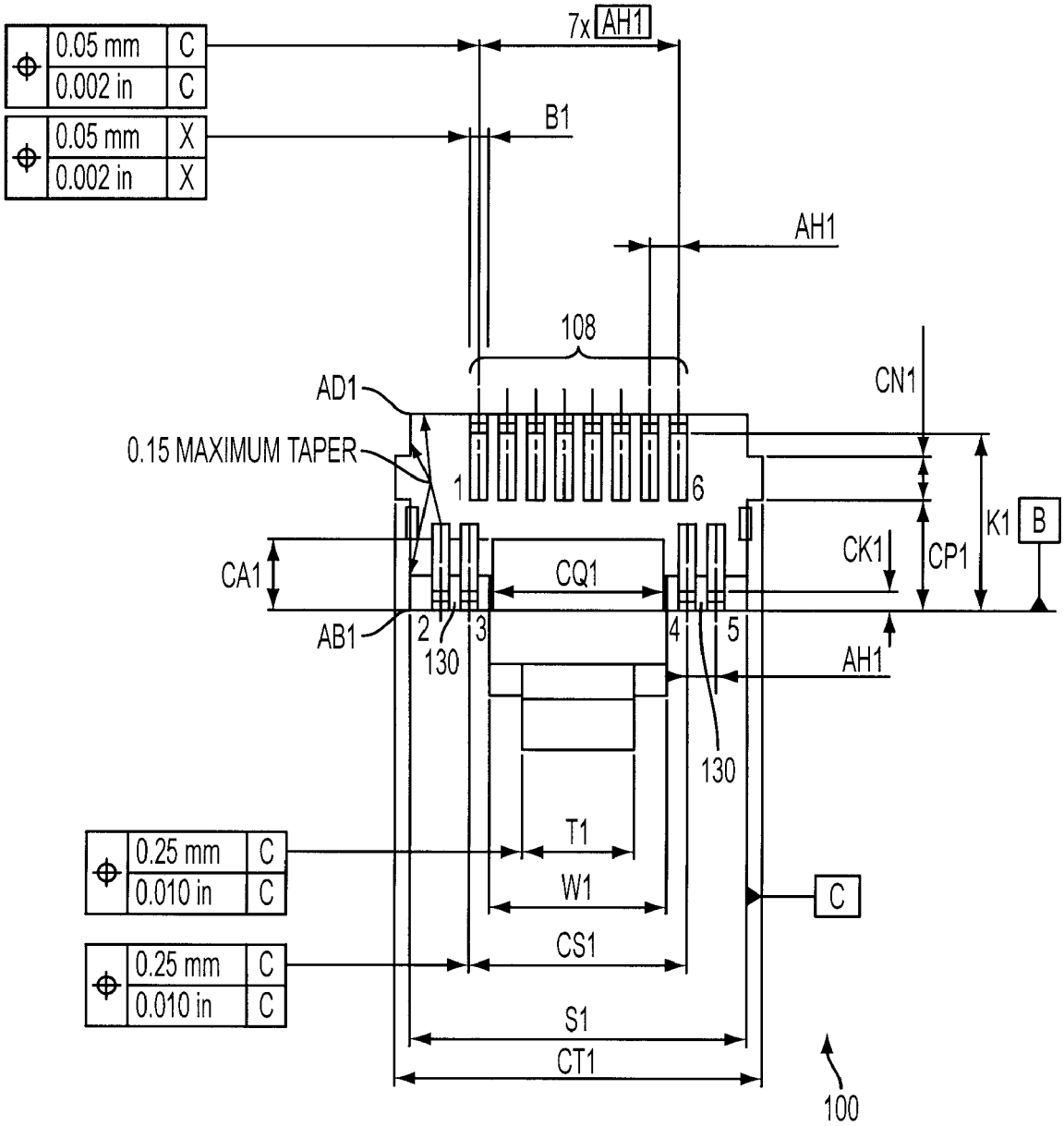
FIG. 15 is a front cut-away view of a jack in accordance with an embodiment of the invention.
Figure 16:
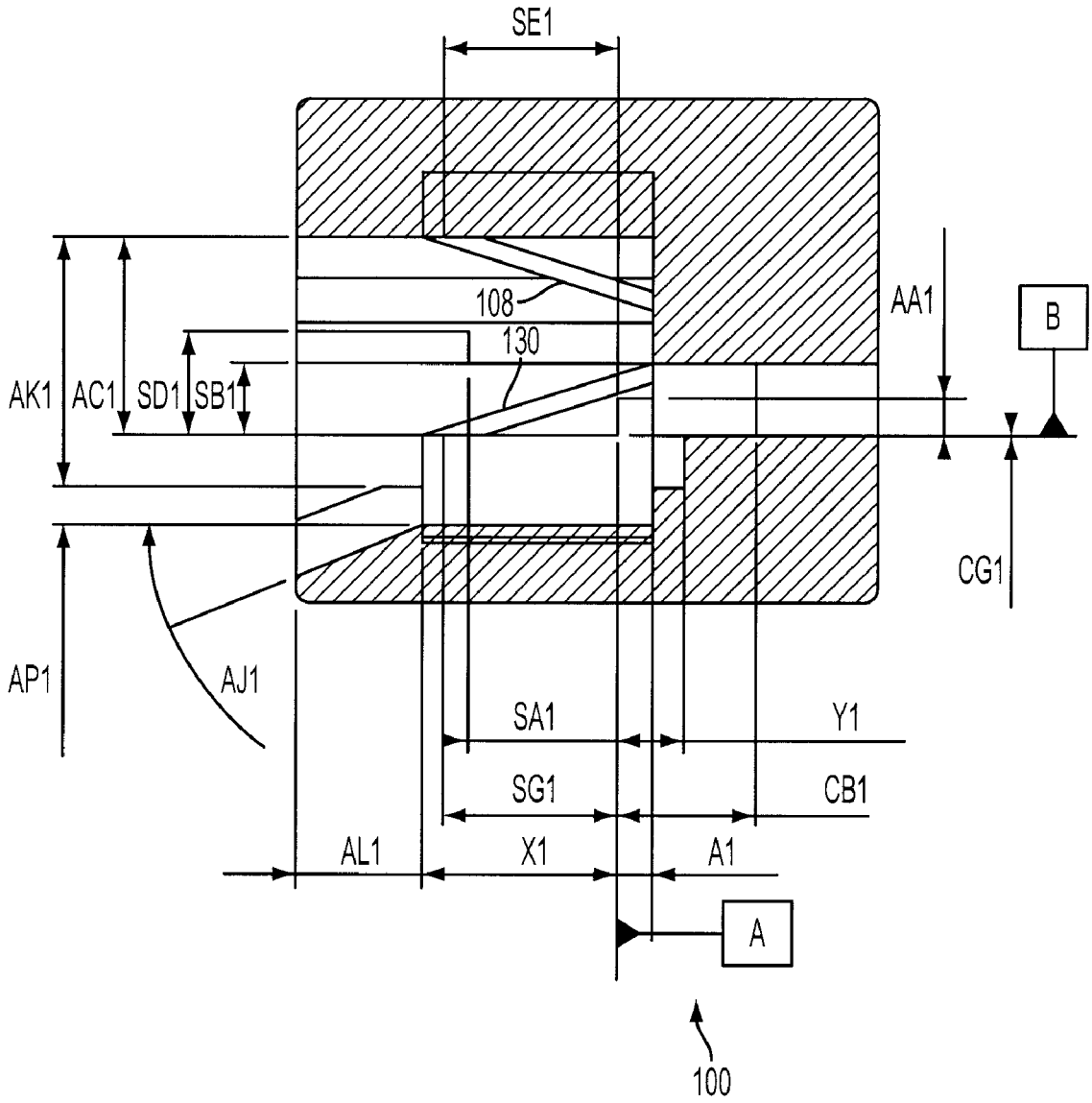
FIG. 16 is a side cut-away view of a jack in accordance with an embodiment of the invention.

Referring to FIGS. 15-18, there are shown various dimensions for the spacing of contacts on Category 7 connectors. FIG. 15 is a front cut-away view of a Category 7 connector and FIG. 16 is a side cut-away view of Category 7 connector. FIGS. 17 and 18 are charts listing some of the preferred dimensions for the various structures though it should be clear that other dimensions could be used and would be within the scope of the invention.

Figure 19:
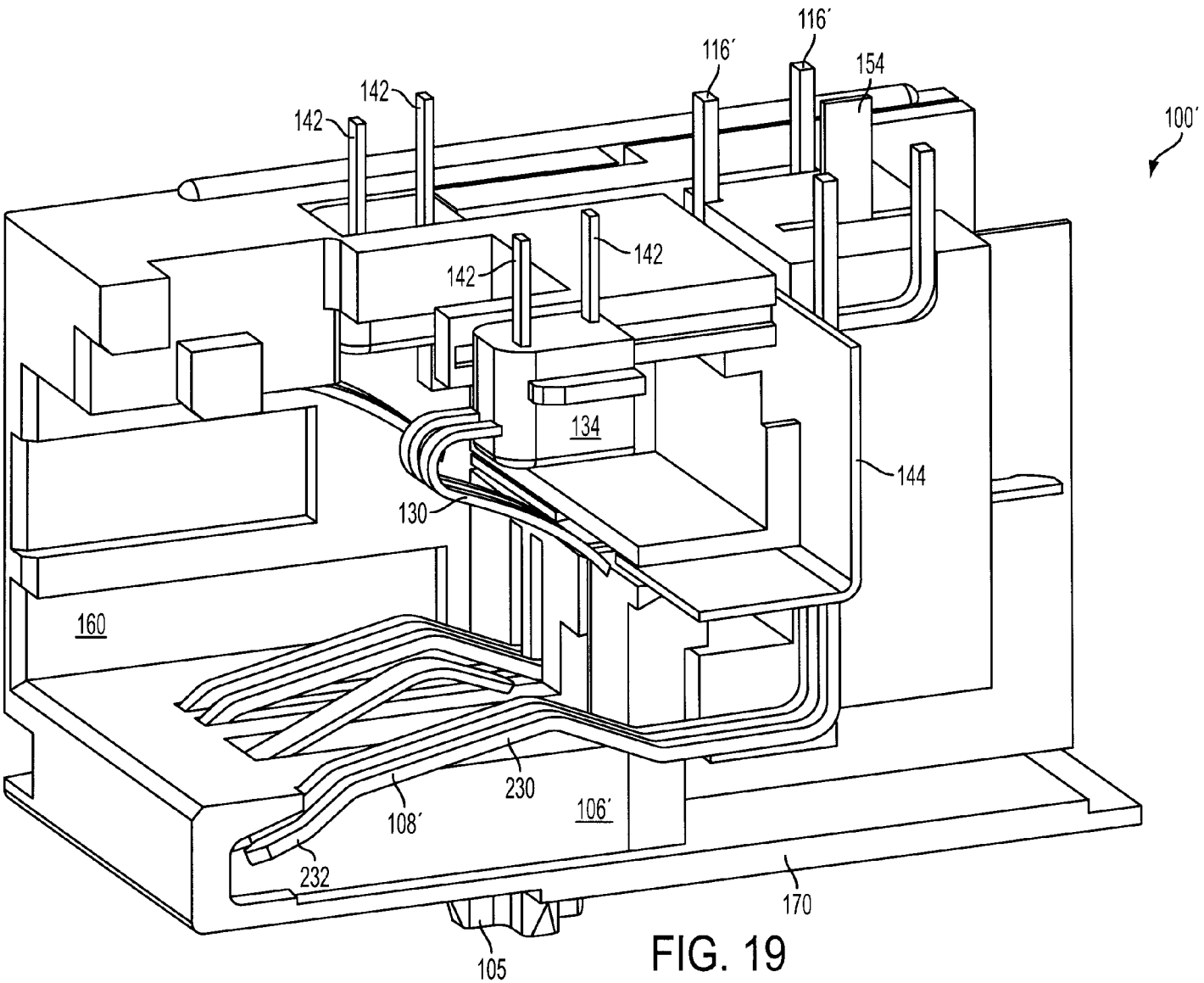
FIG. 19 is a side perspective cut-away view of a jack in accordance with an embodiment of the invention.

Referring to FIG. 19, there is shown another embodiment of the invention. In FIG. 19, a jack 100' includes many of the same components as jack 100 and a detailed description of these components is therefore omitted. For example, shield 154 may be used with jack 100'. Jack 100' includes upper contacts 108' (shown at a lower portion of the figure) shaped differently from upper contacts 108 of connector 100. Contacts 108' include contact portions 230 effective to communicate with contacts of a plug (not shown) and a base portion 232. Base portion 232 is captured under a lip of base portion 106'. Upper contacts 108' continue through pass through housing 104 and terminate at pins 116'. In this embodiment, mounting post 104 is disposed distal from both terminals 142 of lower contacts 130 and terminals 116' of upper contacts. The use of the terms "upper" and "lower" are for convenience only and can be used interchangeably. For example, mounting post 104 may be used to mount connector 100 or connector 100' from above or from below. In the embodiment of FIG. 19, all of terminals 142 and 116' from both lower contacts 130 and upper contacts 108' emerge at the top of jack 100'. The structures shown for upper contacts 130 and for mounting post 104' could be used with any of the previously described embodiments.

Figure 20:
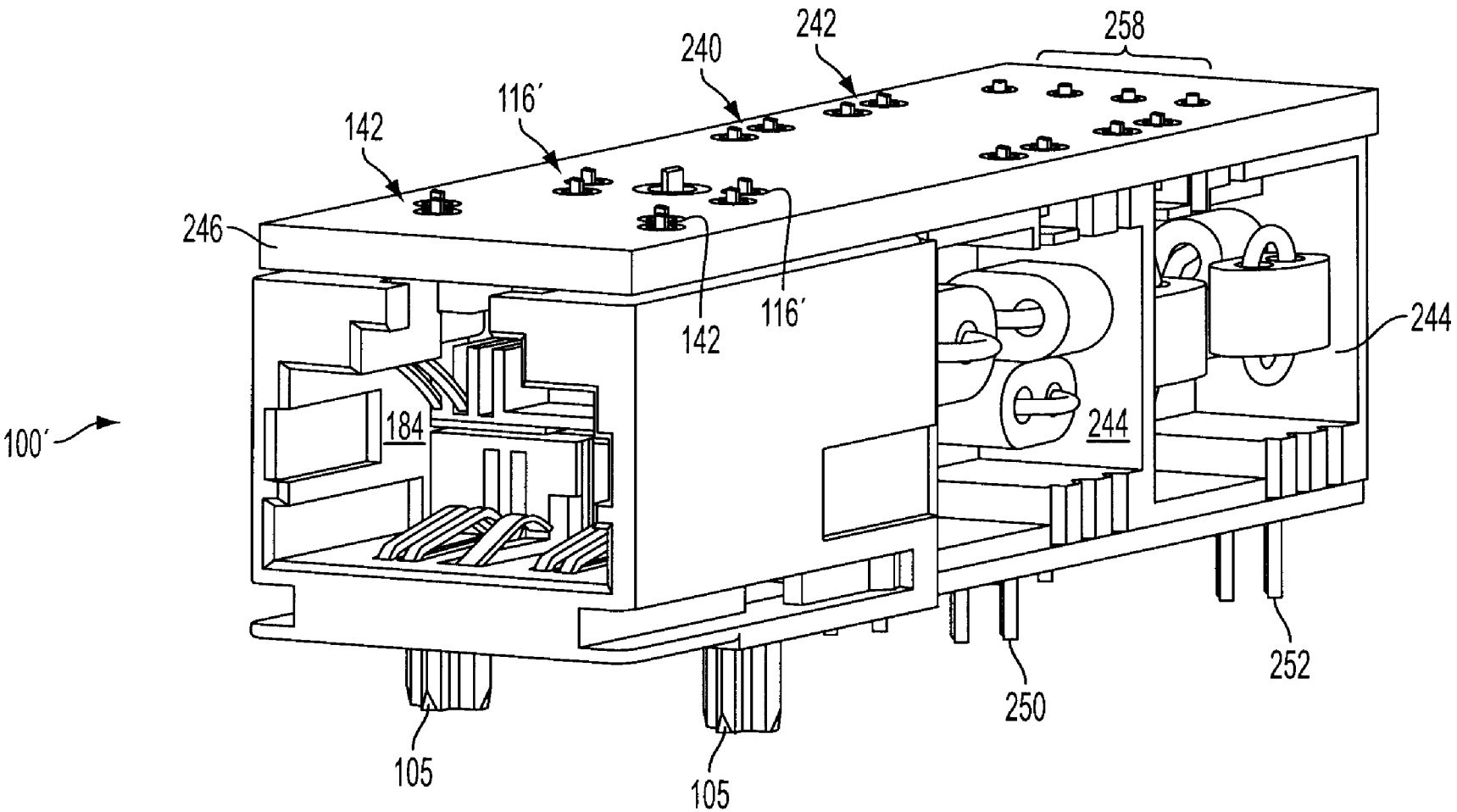
FIG. 20 is a front perspective cut-away view of a jack in accordance with an embodiment of the invention.

Referring to FIG. 20, there is shown a more complete view of jack 100'. As shown, jack 100' includes an upper printed circuit board 246 from which terminals 142 and 116' of both lower contacts 130 and upper contacts 108' extend. Also extending from upper circuit board 246 are input terminals 240 and 242 which are in electrical communication (circuitry not shown) with ends 142 and 116'. Terminals 240 and 242 are connected to magnetic filter circuits 244. Magnetic filter circuits 244 may be used to remove spurious signals moving through jack 100' and/or may be used to remove any signal interference such as that caused by electromagnetic waves incident upon jack 100'. As shown, two input terminals 240 and two input terminals 242 are connected to respective magnetic filter circuits 244—i.e. there are four magnetic filter circuits, each with its own set of cores. An output of the magnetic filter circuits 244 is fed to output terminals 250 and 252 respectively.

Figure 21:
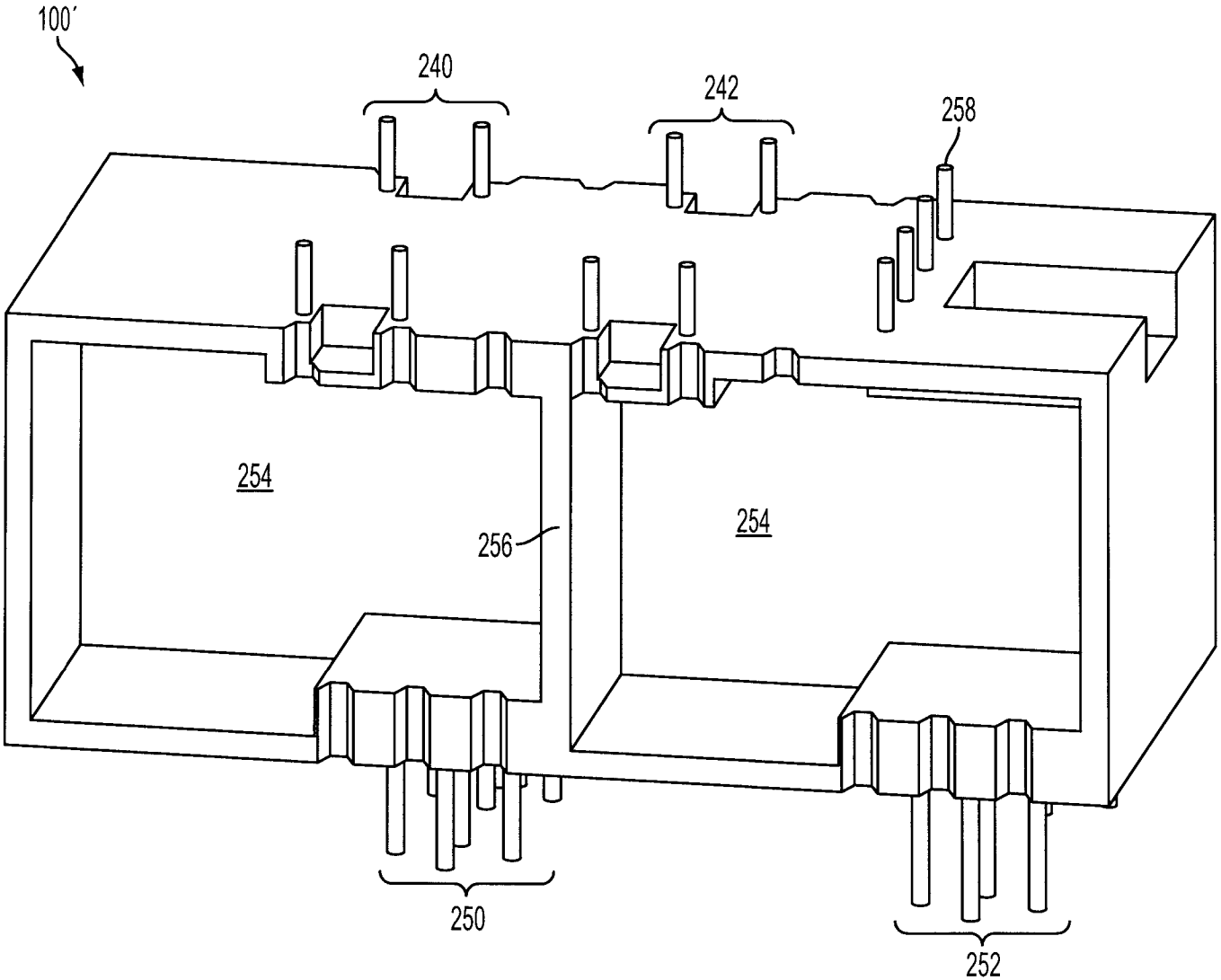
FIG. 21 is a side perspective cut-away view of a housing which could be used in accordance with an embodiment of the invention.

Referring to FIG. 21, each magnetic filter circuit 244 is disposed in its own filter cavity 254. A housing divider 256 disposed on either side of connector 100' separates and defines these cavities. Jumper pins 258 extend away from upper circuit board 246 and are used to provide electrical communication to magnetic filter circuits 244.

Referring to FIG. 22, there is shown an example of circuit which may be used for magnetic filter circuits 244. Also shown is circuitry 270 which may be used to connect terminals 142 and 116' with input terminals 240, 242, and circuitry 272 which may be used to connect magnetic filter circuits 244 to output terminals 250, 252. Also shown are some tolerances for the circuit elements depicted. Clearly these elements and tolerances may be changed without altering the scope of the invention.

Figure 23:
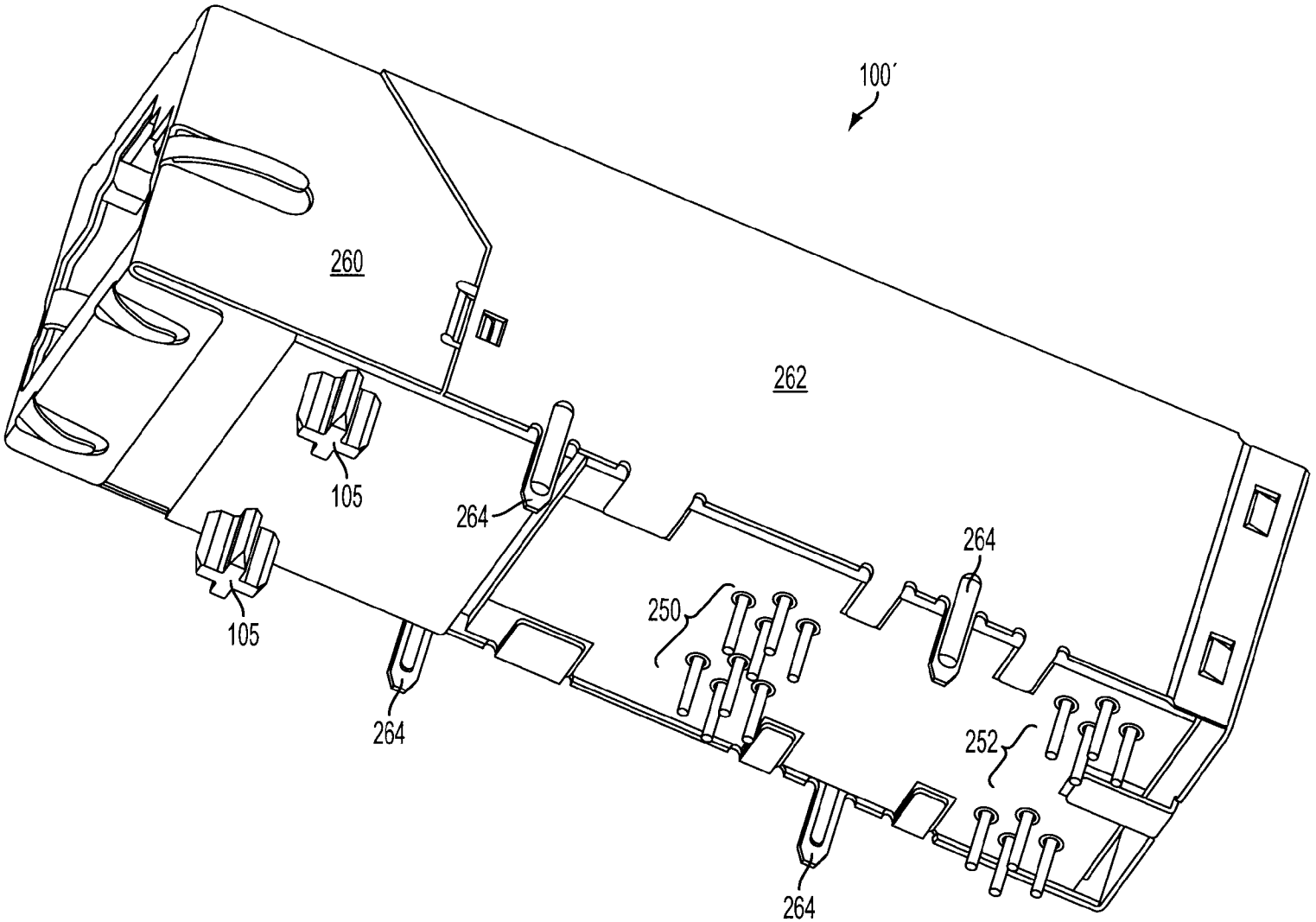
FIG. 23 is a bottom perspective view of a jack in accordance with an embodiment of the invention.

Referring to FIG. 23, there is shown a view of jack 100' including a shield. As with jack 100, jack 100' includes a shield front 260, a shield rear 262 and grounding posts 264 used in grounding the shield to a circuit board (not shown).

Figure 24:
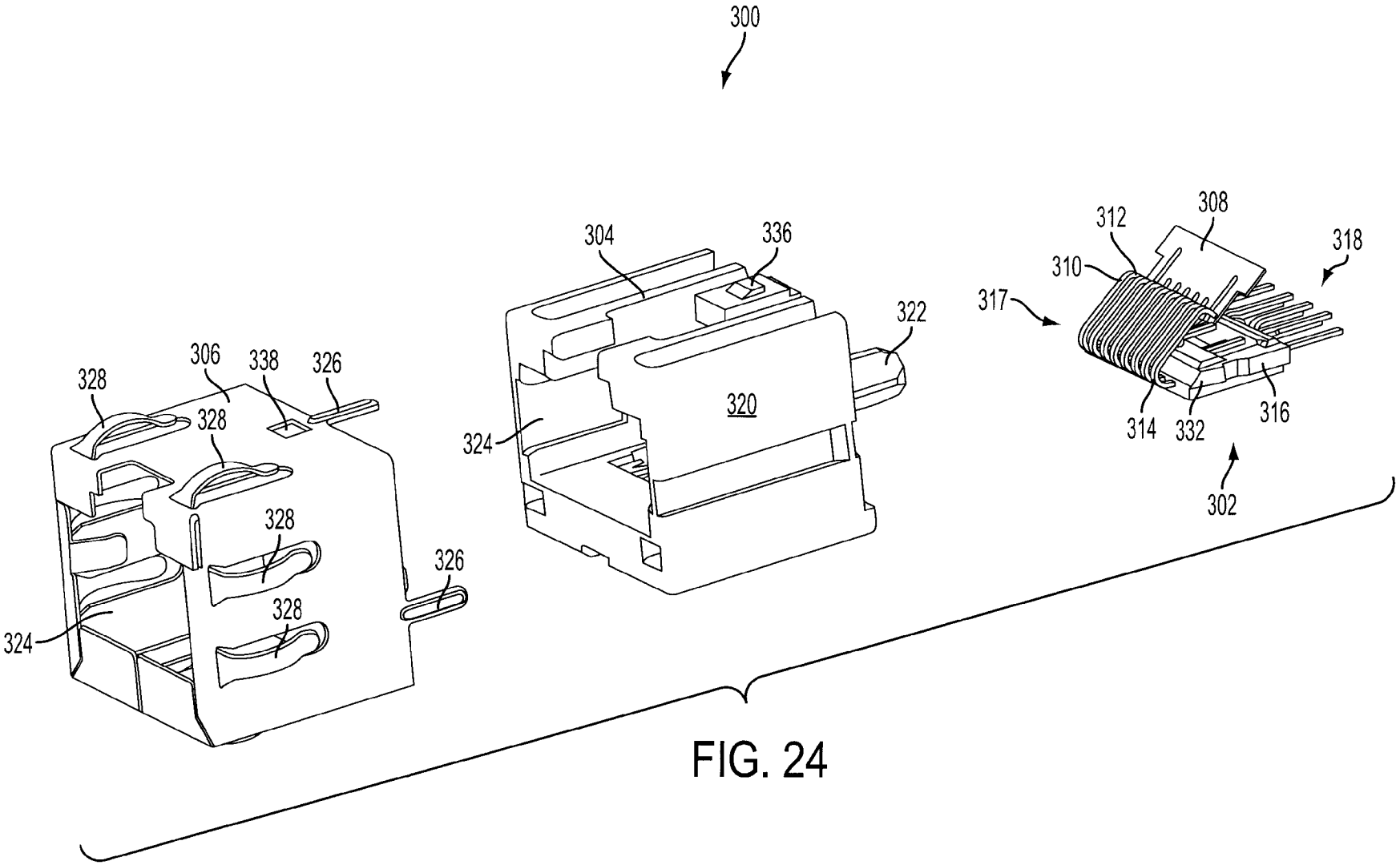
FIG. 24 is a side perspective exploded view of a jack in accordance with an embodiment of the invention.
Figure 25:
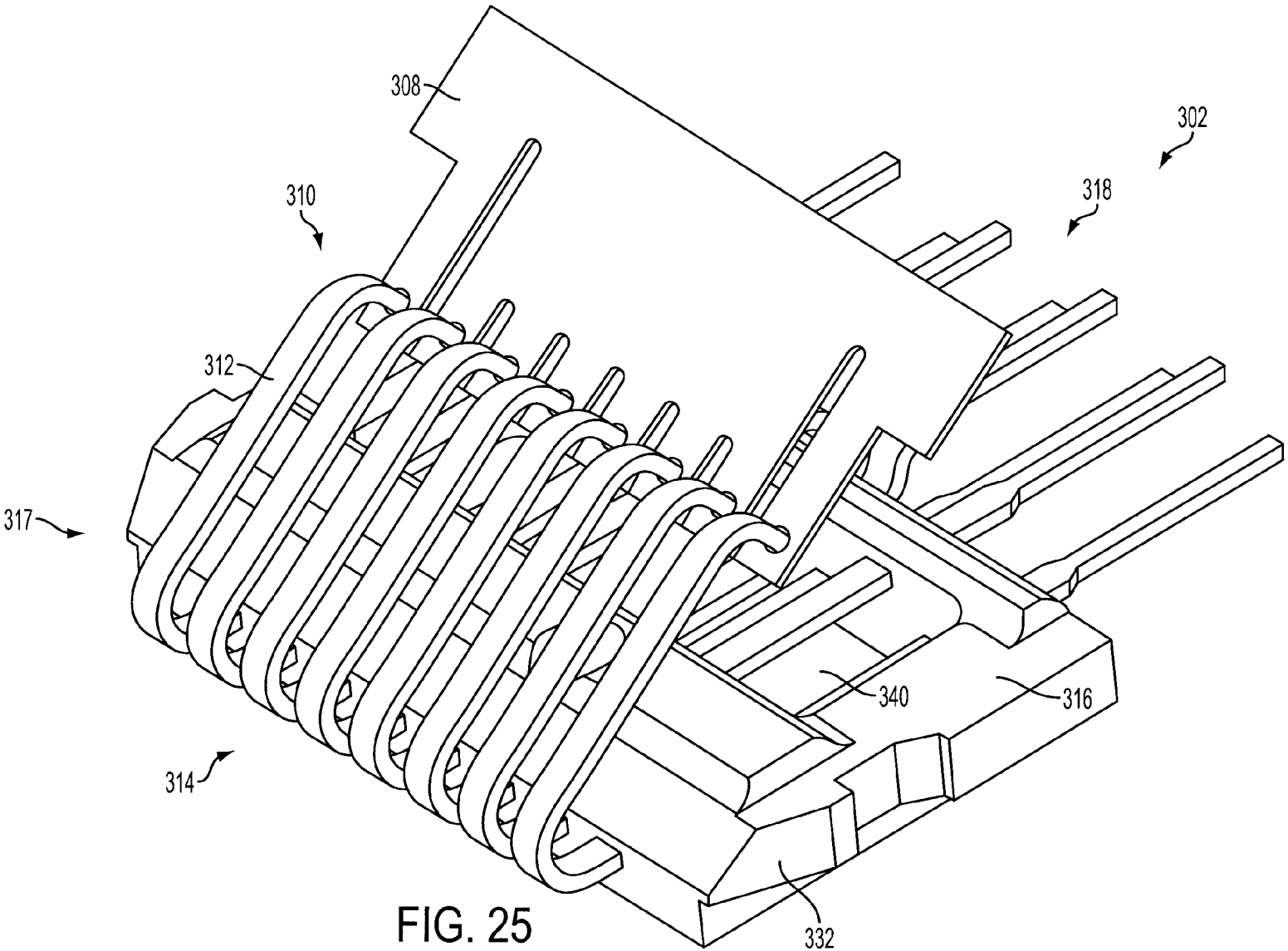
FIG. 25 is a front perspective view of a contact block in accordance with an embodiment of the invention.
Figure 26:
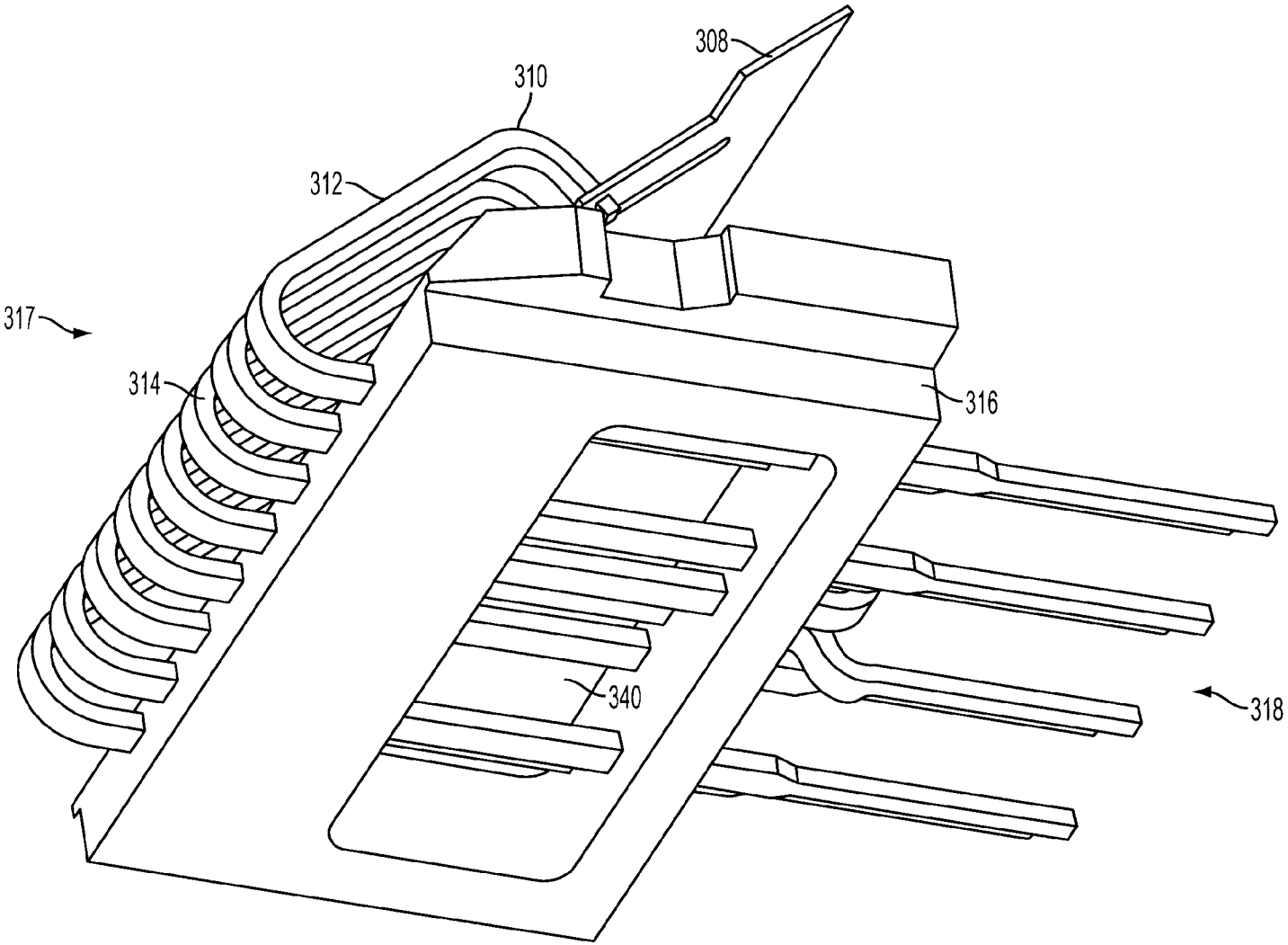
FIG. 26 is a bottom perspective view of a contact block in accordance with an embodiment of the invention.

Referring to FIG. 24, there is shown a jack 300 in accordance with another embodiment of the invention. Jack 300 may receive a plug inserted in a direction perpendicular to a plane defined by a surface of a circuit board (not shown) where jack 300 is mounted—sometimes referred to as a "vertical jack". Jack 300 includes a contact block 302, a housing 304 and a shield 306. Referring also to FIGS. 25 and 26, contact block 302 includes a base plastic member 316 carrying contacts 317 having an arcuate portion 314, a contact portion 312, an end portion 310 and a terminal end 318. Plastic member 316 further includes a tongue 332 (discussed below). End portion 310 is connected to flexible substrate 308 including compensation circuitry as discussed above. Contacts further include terminal ends 318 used in connecting with a circuit board (not shown). Base plastic member 316 may have a central portion cut-out (shown at 340) to reduce the dielectric constant of the base plastic member 316 and to improve relevant electrical properties.

Housing 304 includes walls 320 defining a plug receiving cavity 324, a mounting post 322 used in mounting jack 300 to a circuit board (not shown), a flexible tab 336 biased upwardly and a groove 324. Shield 306 includes spring members 328, effective to facilitate grounding of jack 300, and spring biased outwardly from a base of shield 306. Shield 306 further includes ground posts 326 and a void 338 effective to receive and retain tab 336 of housing 304 therein.

Figure 27:
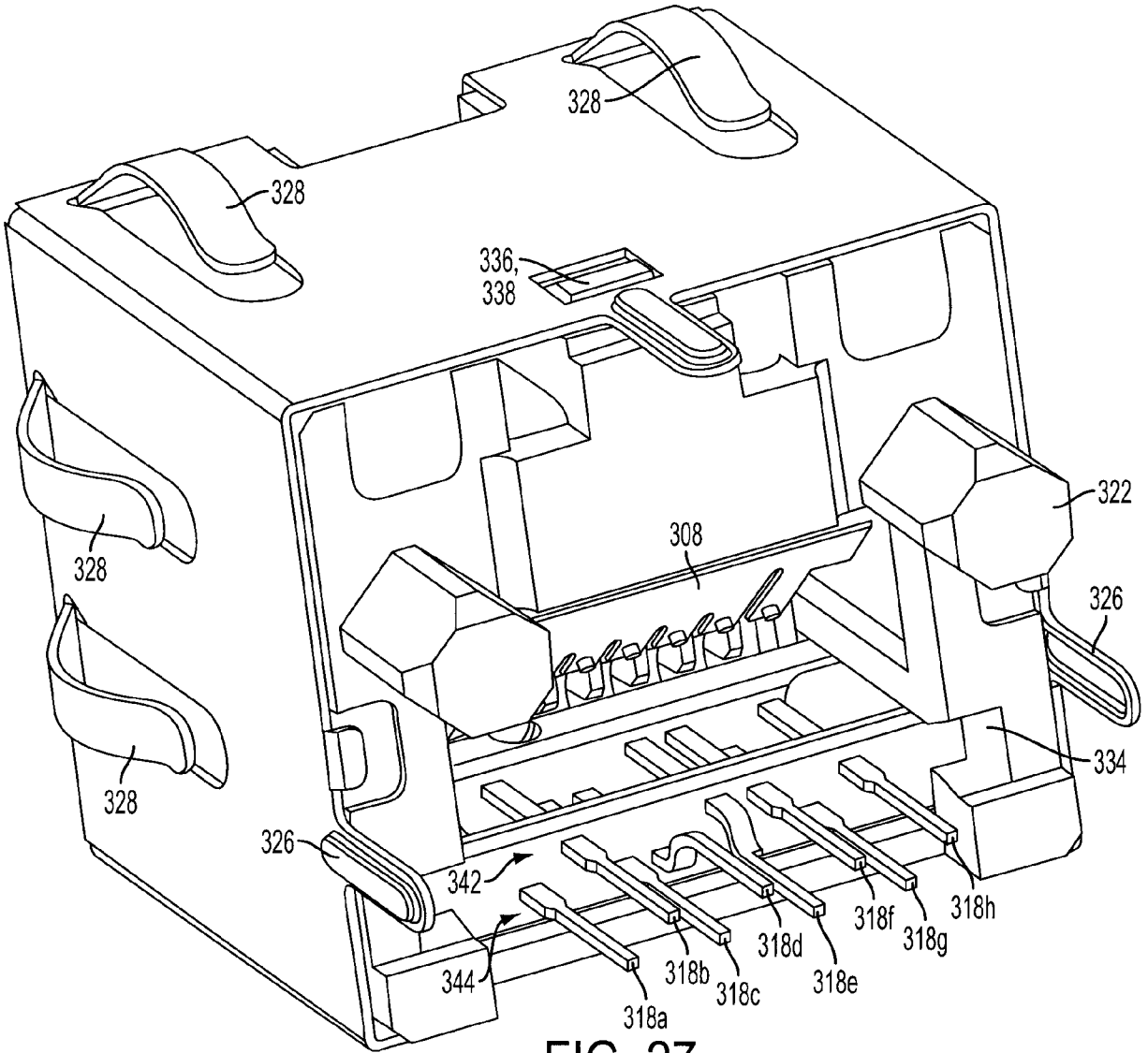
FIG. 27 is a rear perspective view of a jack in accordance with an embodiment of the invention.
Figure 28:
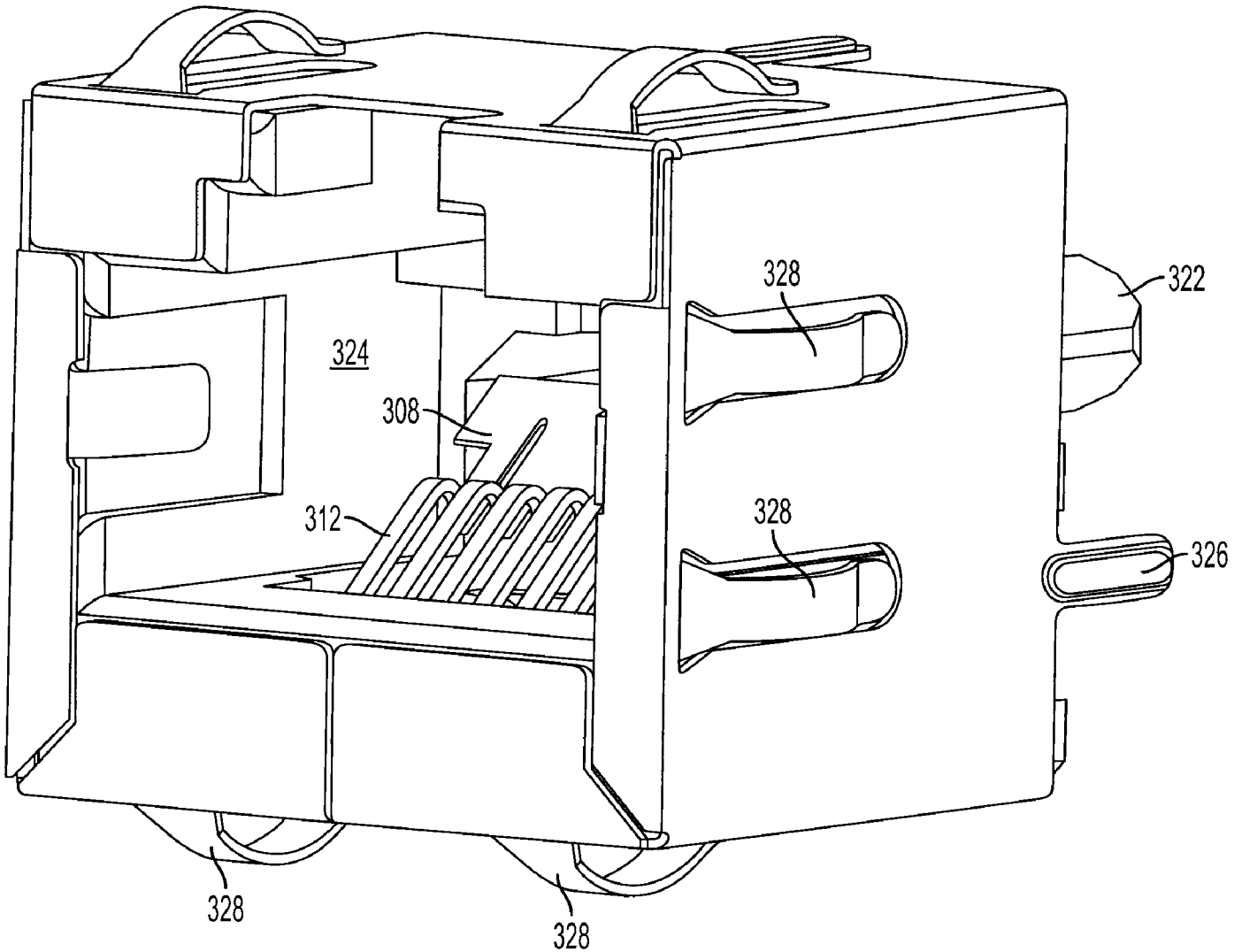
FIG. 28 is a front perspective view of a jack in accordance with an embodiment of the invention.

Referring to FIGS. 24, 27 and 28, to assemble jack 300, a user may slide tongue 332 of contact block 302 into groove 334 (FIG. 27) of housing 304 and then insert housing 304 into shield 306 so that tab 336 mates with void 338.

Figure 29:
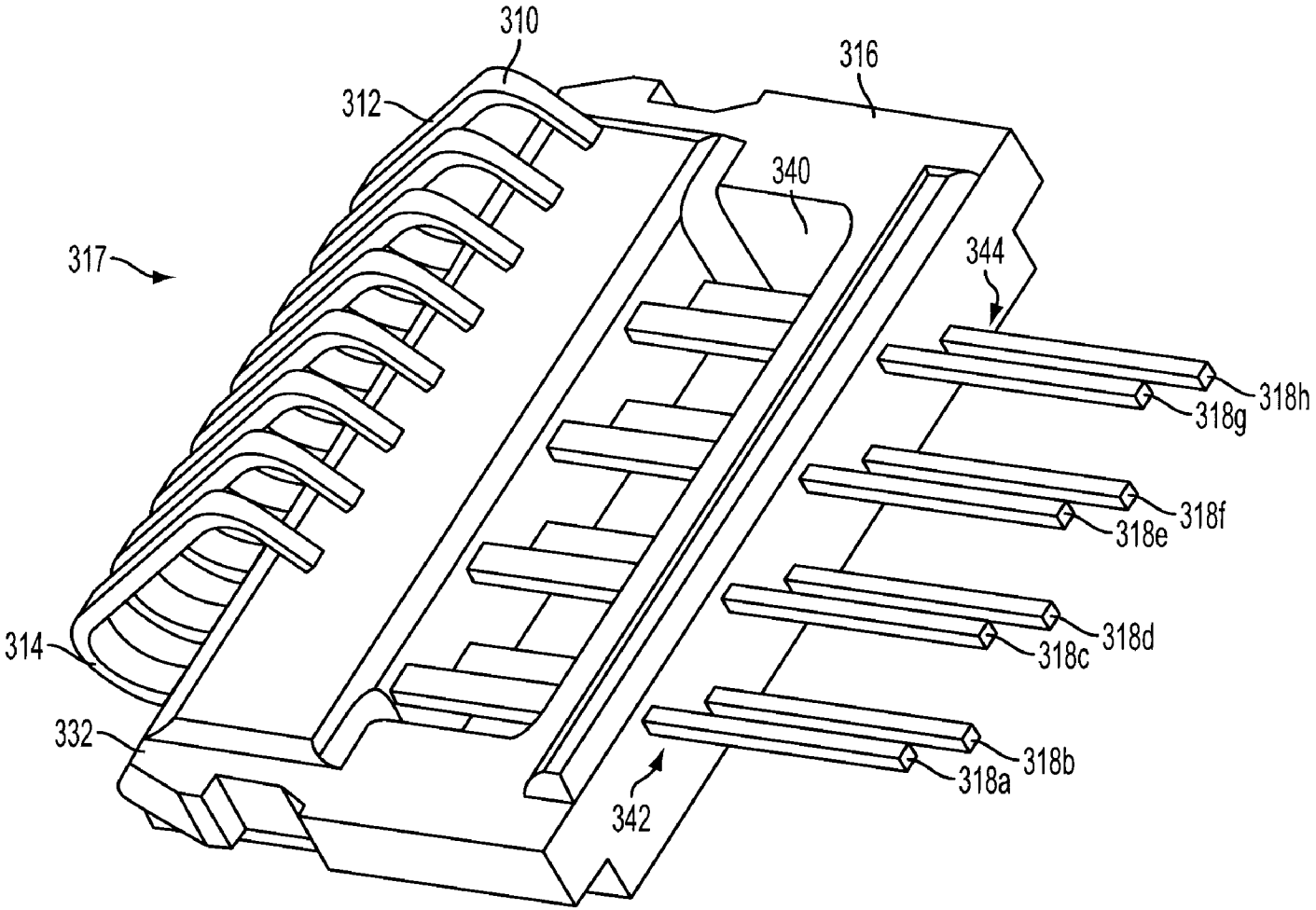
FIG. 29 is a top perspective view of a contact block in accordance with an embodiment of the invention.

As shown most clearly in FIGS. 26 and 27, terminal ends 318 enter base plastic member 316 in a single plane (FIG. 26) but may move to different planes inside plastic member 316 (as best seen through cut-away 340) and exit plastic member 316 in different planes. As shown in FIG. 27, terminals ends 318 may exit plastic member 316 at a first plane 342 and a second plane 344. Terminal ends 318*a*, 318*b*, 318*c*, 318*f*, 318*g* and 318*h* remain in their respective planes 342 and 344. However, terminal ends 318*d* and 318*e* (which may correspond to wires 4 and 5) may optionally cross-over so that they terminate in different planes. Terminal ends 318 may alternatively remain in their respective planes 342, 344 as shown in FIG. 29.

Figure 30:
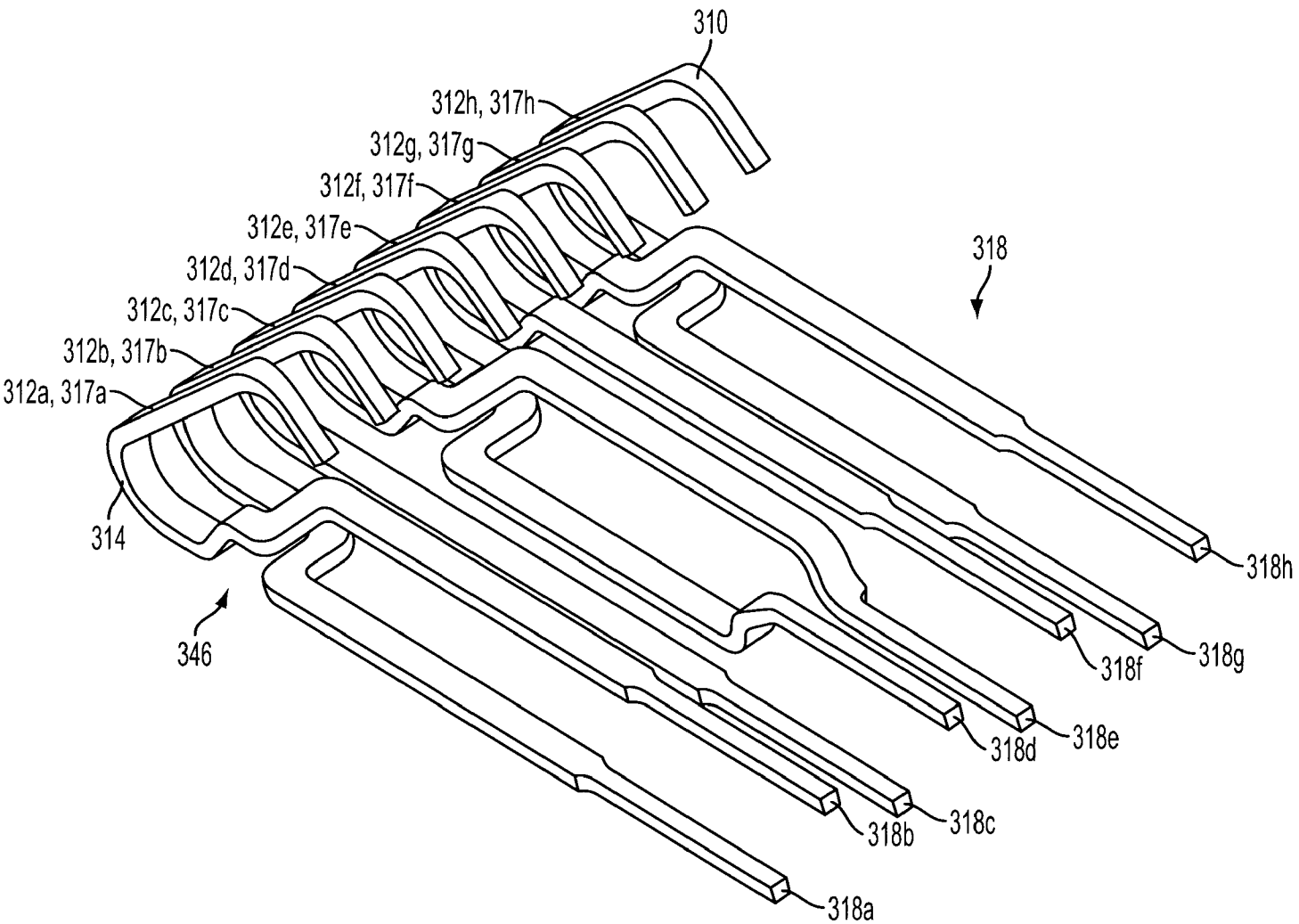
FIG. 30 is a top perspective view of a plurality of contacts in accordance with an embodiment of the invention.
Figure 31:
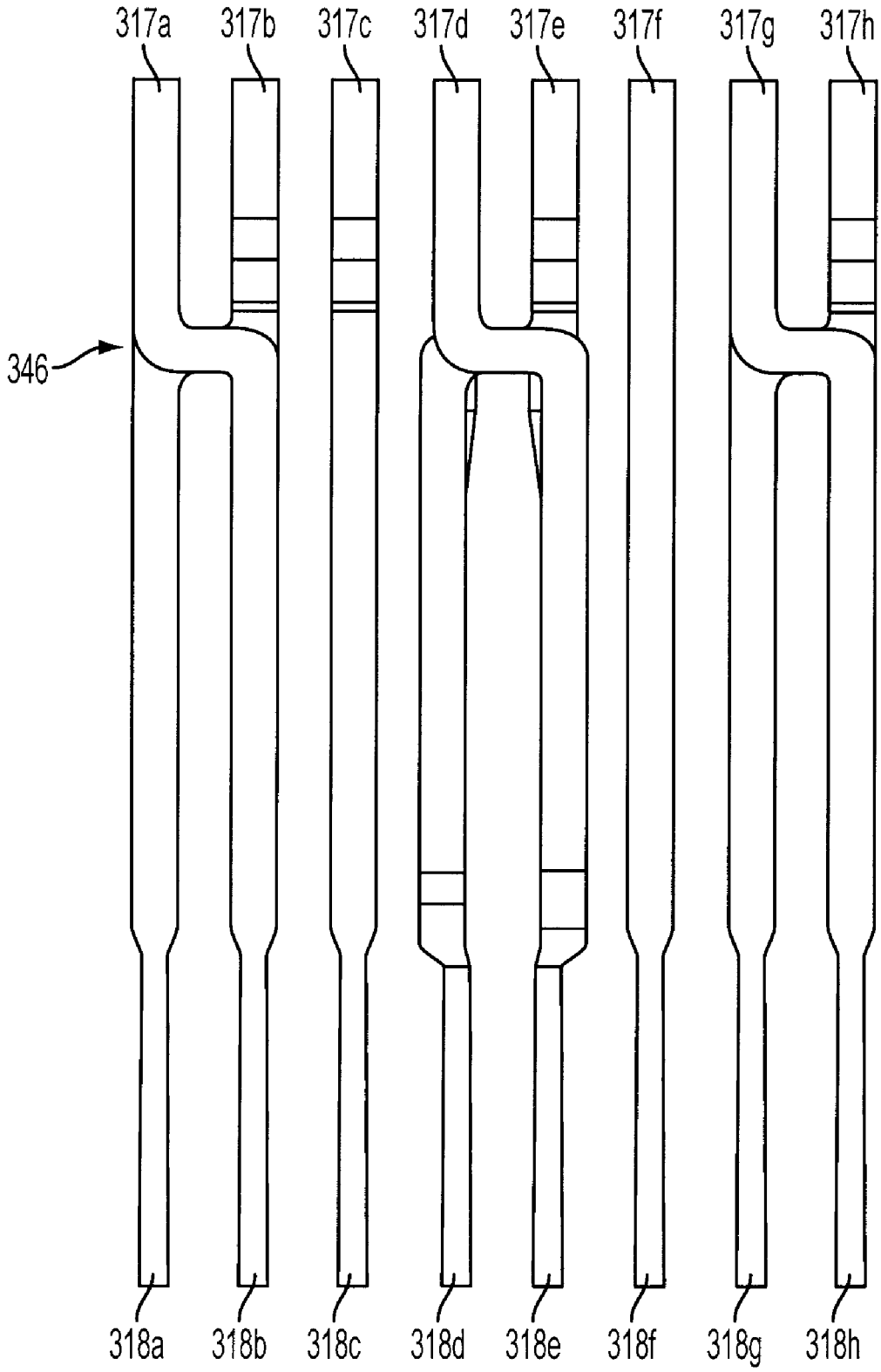
FIG. 31 is a top view of a plurality of contacts in accordance with an embodiment of the invention.

Inside plastic member 316, the contacts 317 may cross-over one another one or more times to reduce cross-talk between contacts. As shown in FIGS. 30 and 31 (with plastic member 316 removed for illustration), in addition to the optional cross-over of terminal ends 318*d*, 318*e*, contacts 317*a* and 317*b* may cross-over inside plastic member 316 at cross-over point 346 so that contact portions 312*a*, 312*b* terminate in terminal ends 318*b* and 318*a* respectively. Similarly, contacts 317*d* and 317*e* may cross-over inside plastic member 316 so that contact portions 312*d*, 312*e* terminate in terminal ends 318*e* and 318*d* respectively; and contacts 317*g* and 317*h* may cross-over inside plastic member 316 so that contact portions 312*g*, 312*h* terminate in terminal ends 318*h* and 318*g* respectively.

Figure 32:
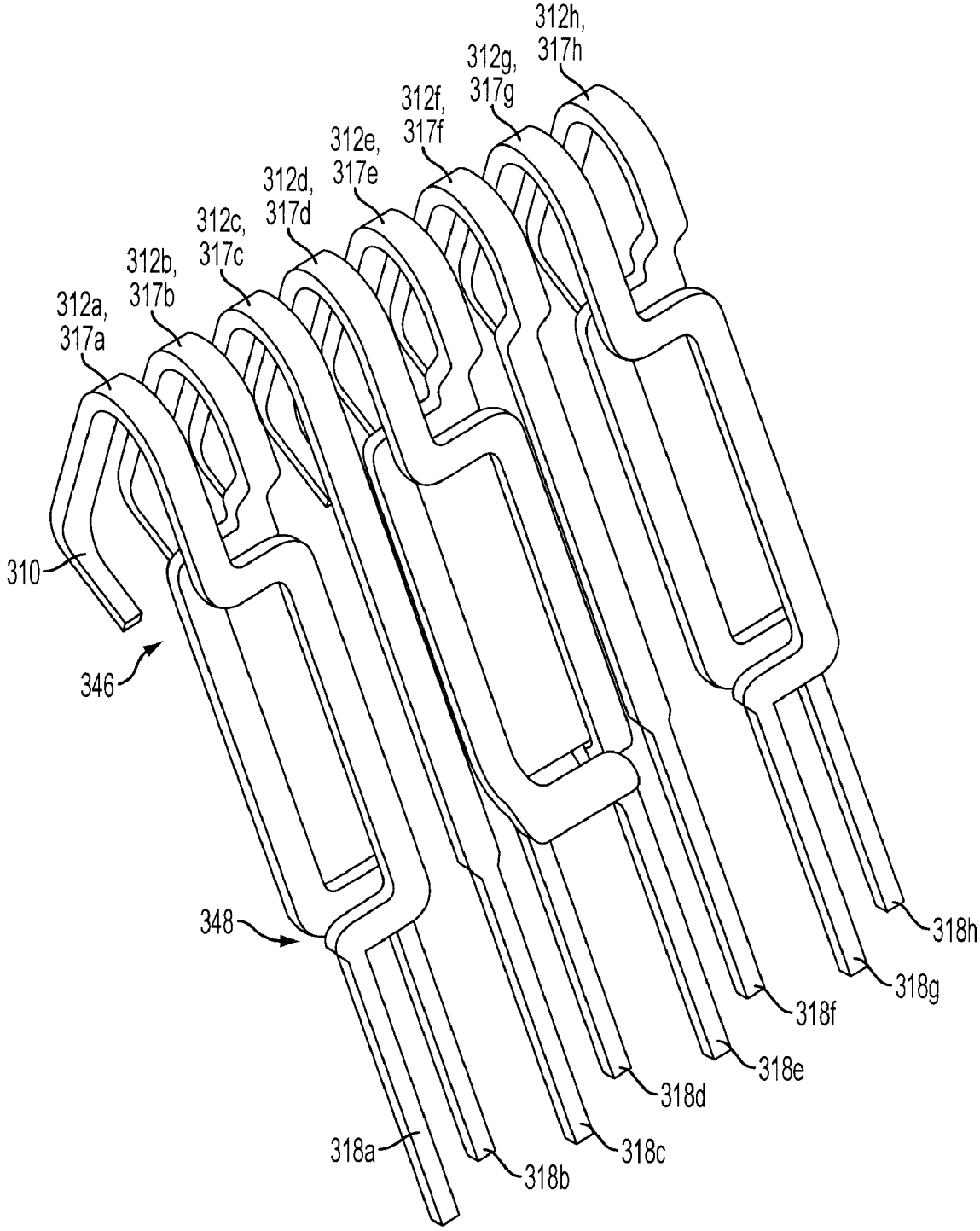
FIG. 32 is a bottom perspective view of a plurality of contacts in accordance with an embodiment of the invention.

Alternatively, as shown in FIG. 32, contacts 317*a*, 317*b*, may cross-over twice at cross-over points 346 and 348 so that contact portions 312*a*, 312*b* terminate in terminal ends 318*a*, 318*b*. Similarly, contacts 317*d*, 317*e*, may cross-over twice so that contact portions 312*d*, 312*e* terminate in terminal ends 318*d*, 318*e* and contacts 317*g*, 317*h*, may cross-over twice so that contact portions 312*g*, 312*h* terminate in terminal ends 318*g*, 318*h*.

Figure 33:
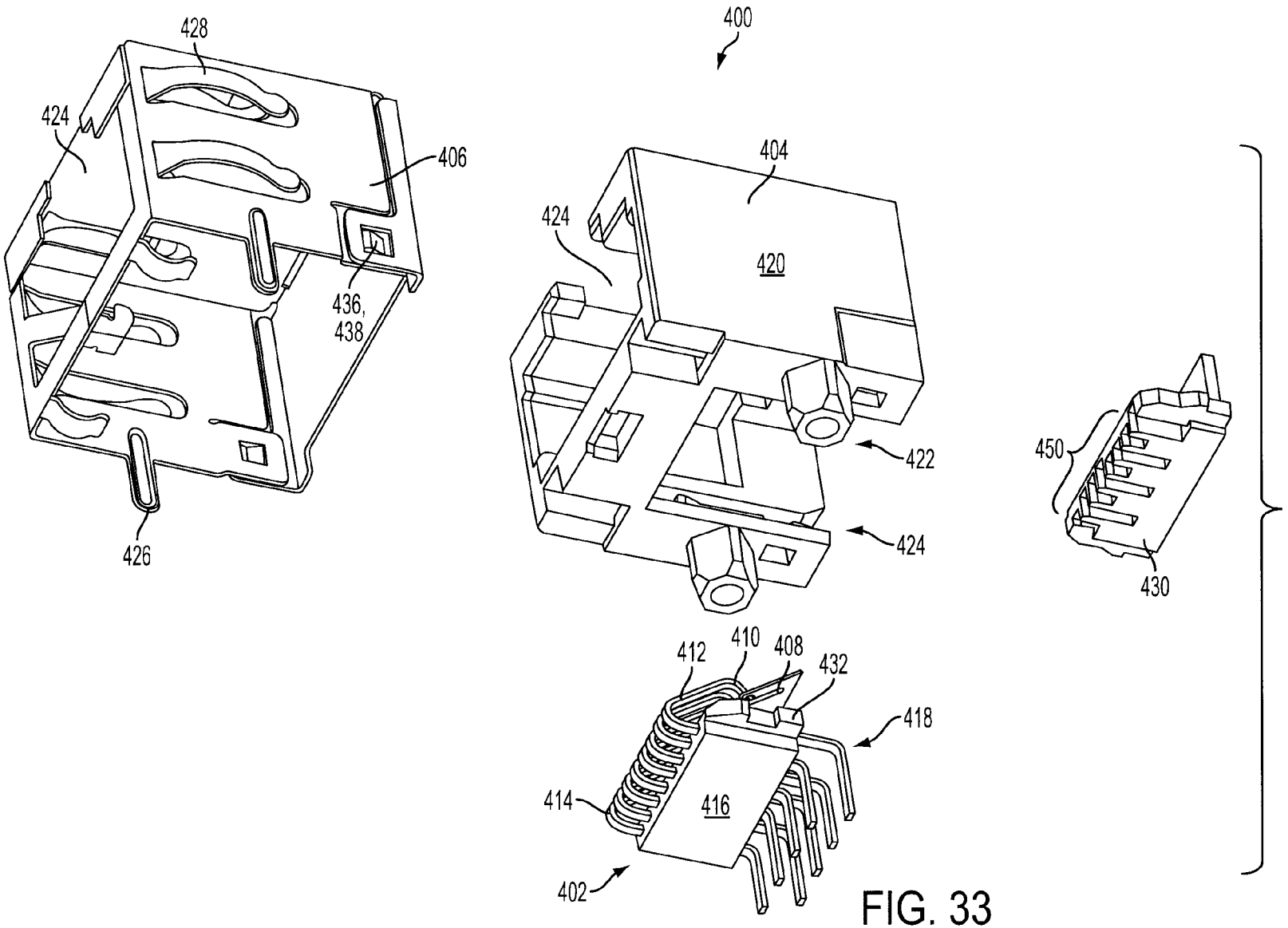
FIG. 33 is a bottom perspective exploded view of a jack in accordance with an embodiment of the invention.
Figure 34:
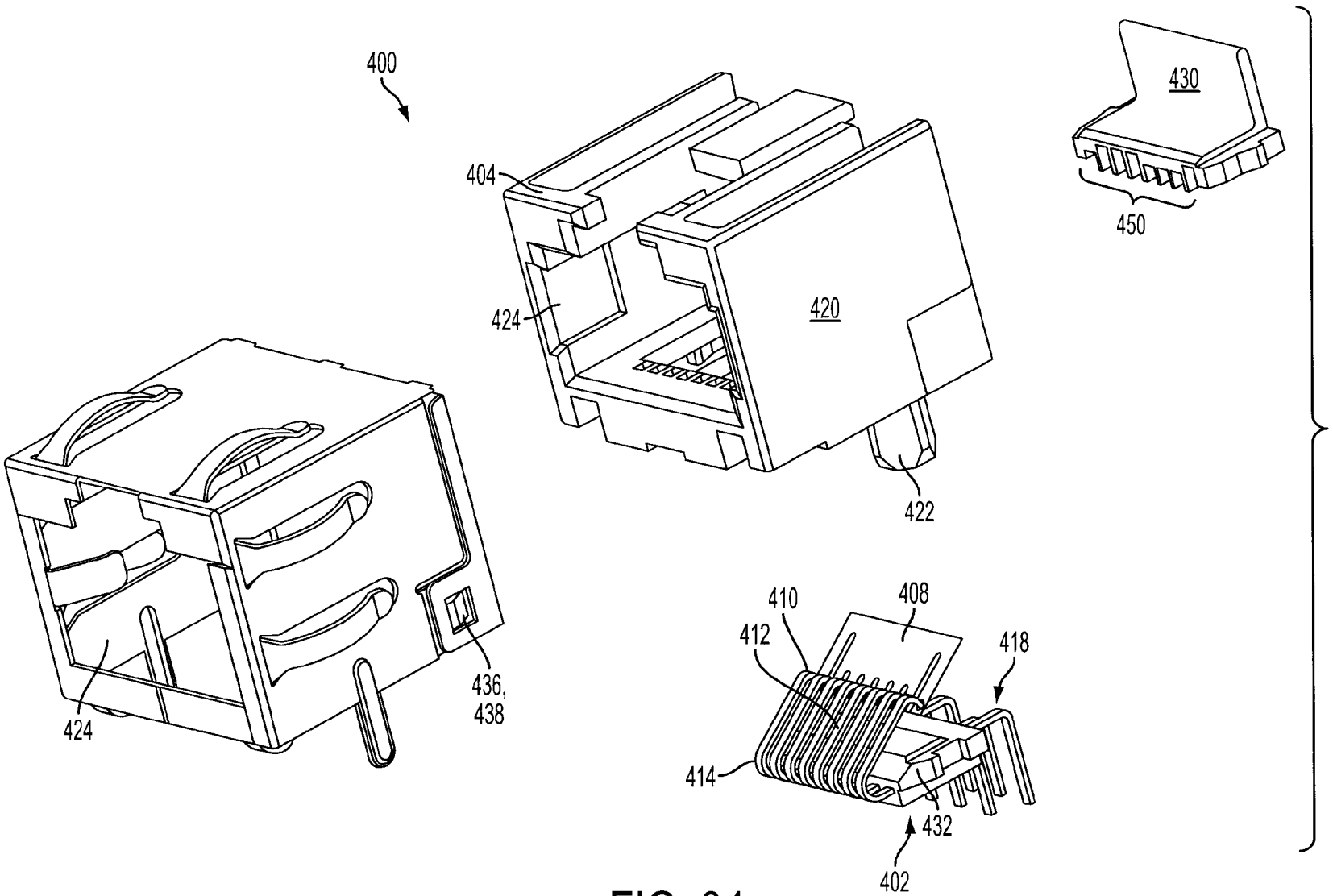
FIG. 34 is a side perspective exploded view of a jack in accordance with an embodiment of the invention.
Figure 35:
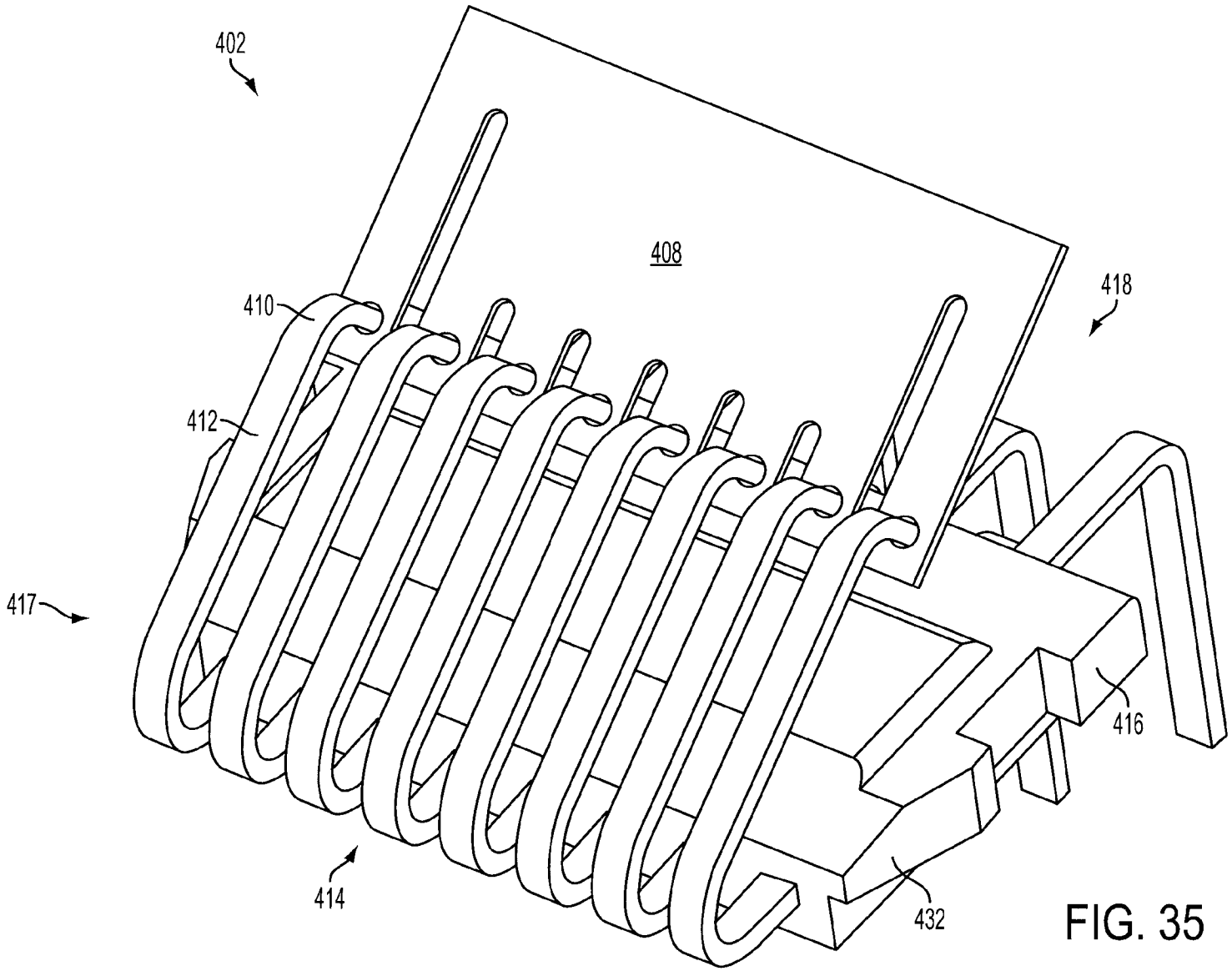
FIG. 35 is a front perspective view of a contact block in accordance with an embodiment of the invention.

Referring to FIGS. 33 and 34, there is shown a jack 400 in accordance with another embodiment of the invention. Jack 400 may receive a plug inserted in a direction parallel to a plane defined by a surface of a circuit board (not shown) where jack 400 is mounted—sometimes referred to as a "horizontal jack". Jack 400 includes a rear cover 430, a contact block 402, a housing 404 and a shield 406. Rear cover 430 includes recesses 450. Referring also to FIG. 35, contact block 402 includes a base plastic member 416 carrying contacts 417 having an arcuate portion 414, a contact portion 412, an end portion 410 and a terminal end 418. Plastic member 416 further includes a tongue 432 (discussed below). End portion 410 is connected to flexible substrate 408 including compensation circuitry as discussed above. Contacts 417 further include terminal ends 418 used in connecting with a circuit board (not shown). Base plastic member 416 may have a central portion cut-out to reduce the dielectric constant of the base plastic member 416 and to improve relevant electrical properties as discussed above or may be solid as shown in the figure.

Housing 404 includes walls 420 defining a plug receiving cavity 424, a mounting post 422 used in mounting jack 400 to a circuit board (not shown), and a groove 424. Shield 406 includes spring members 428, effective to facilitate grounding of jack 400, and spring biased outwardly from a base of shield 406. Shield 400 also includes a ground post 426, a flexible tab 436 biased upwardly and a void 438 effective to receive and retain tab 436 therein. A rear of shield 406 may be opened up to receive housing 404 by disengaging tab 436 from void 438.

Figure 37:
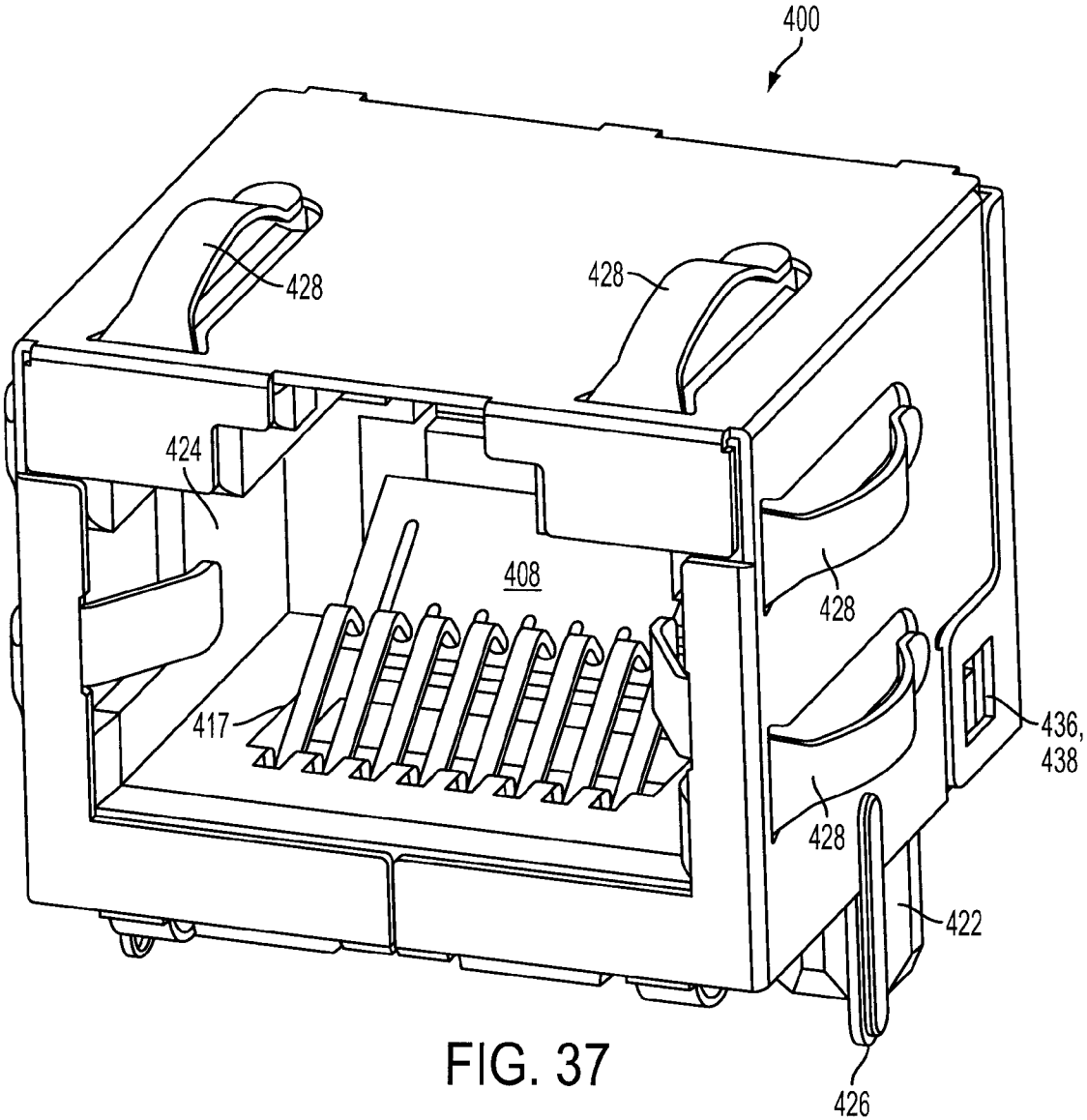
FIG. 37 is a front perspective view of a jack in accordance with an embodiment of the invention.

Referring to FIGS. 33, to assemble jack 400, a user may slide tongue 432 of contact block 302 into groove 424 of housing 304 and then insert housing 404 into shield 406. Rear cover 430 may then be slid on to contact block 402 with recesses 450 of rear cover 430 mating with terminal ends 418. An assembled jack 400 is shown in FIG. 37.

Figure 36:
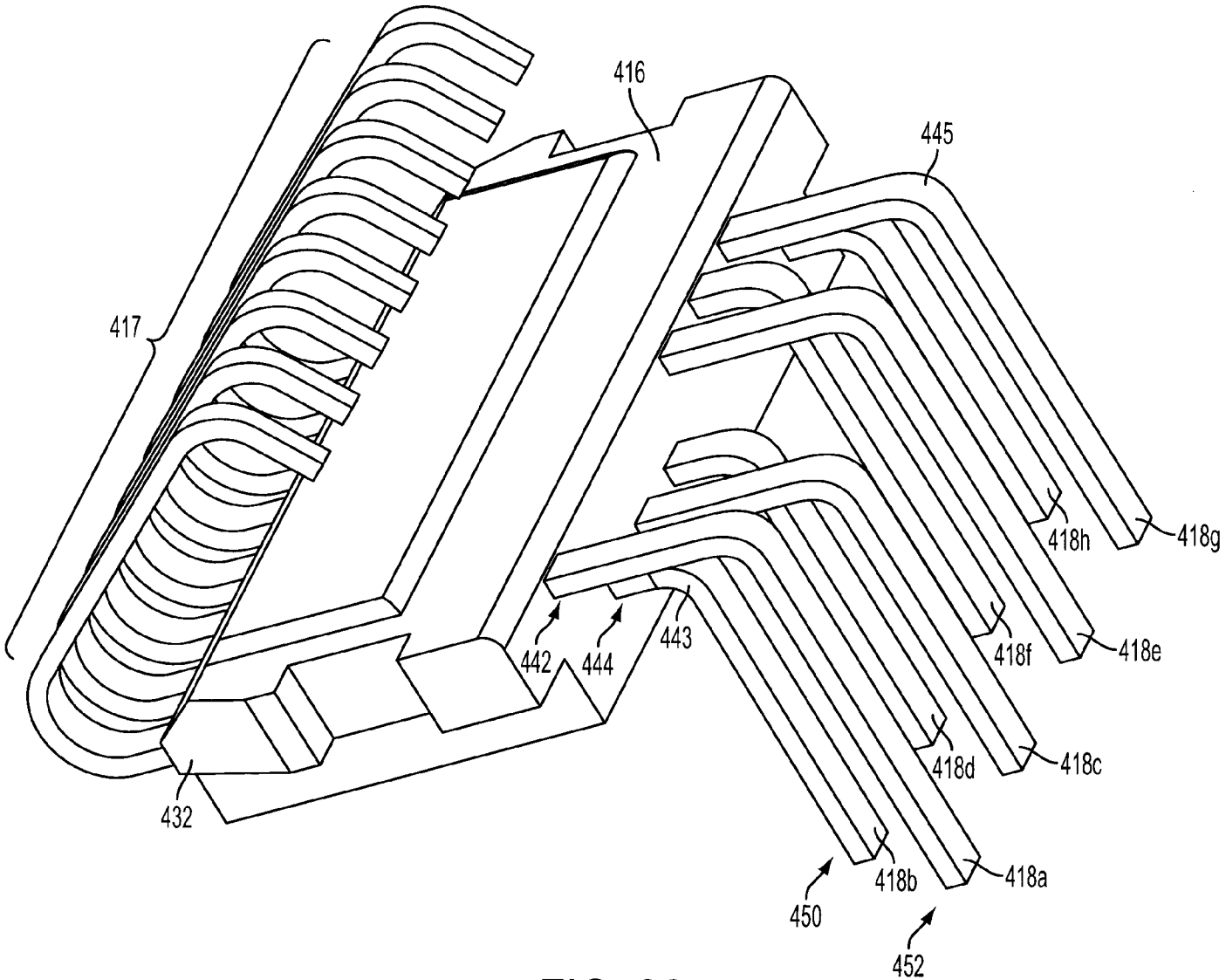
FIG. 36 is a side perspective view of a jack in accordance with an embodiment of the invention.

As shown most clearly in FIGS. 35 and 36, terminal ends 418 enter base plastic member 416 in a single plane but may move to different planes inside plastic member 416 and exit plastic member 416 in different planes. Terminal ends 418*a*, 418*e*, 418*f*, 418*g* may exit plastic member 416 at a first plane 442 and terminal ends 418*b*, 418*c*, 418*d*, and 418*h* may exit plastic member 416 at a second plane 444. Once terminal ends 418 exit plastic member 416, terminal ends 418 may bend downwardly at bends 443 and 445 so as to be insert-able in a circuit board extending parallel to plug receiving cavity 424. As can be seen, terminal ends 418*b*, 418*d*, 418*f* and 418*h* bend at first bends 443 and terminate in a third plane 450. Terminal ends 418*a*, 418*c*, 418*e*, and 418*g* bend at second bends 445 and terminate in a fourth plane 452. Terminals 418*c* and 418*f* cross-over in that they start off in a plane with three terminals and end up in a plane with a different three terminals. Jack 400 may also use the cross-over arrangements discussed above with reference to FIGS. 30-32.

Figure 38:
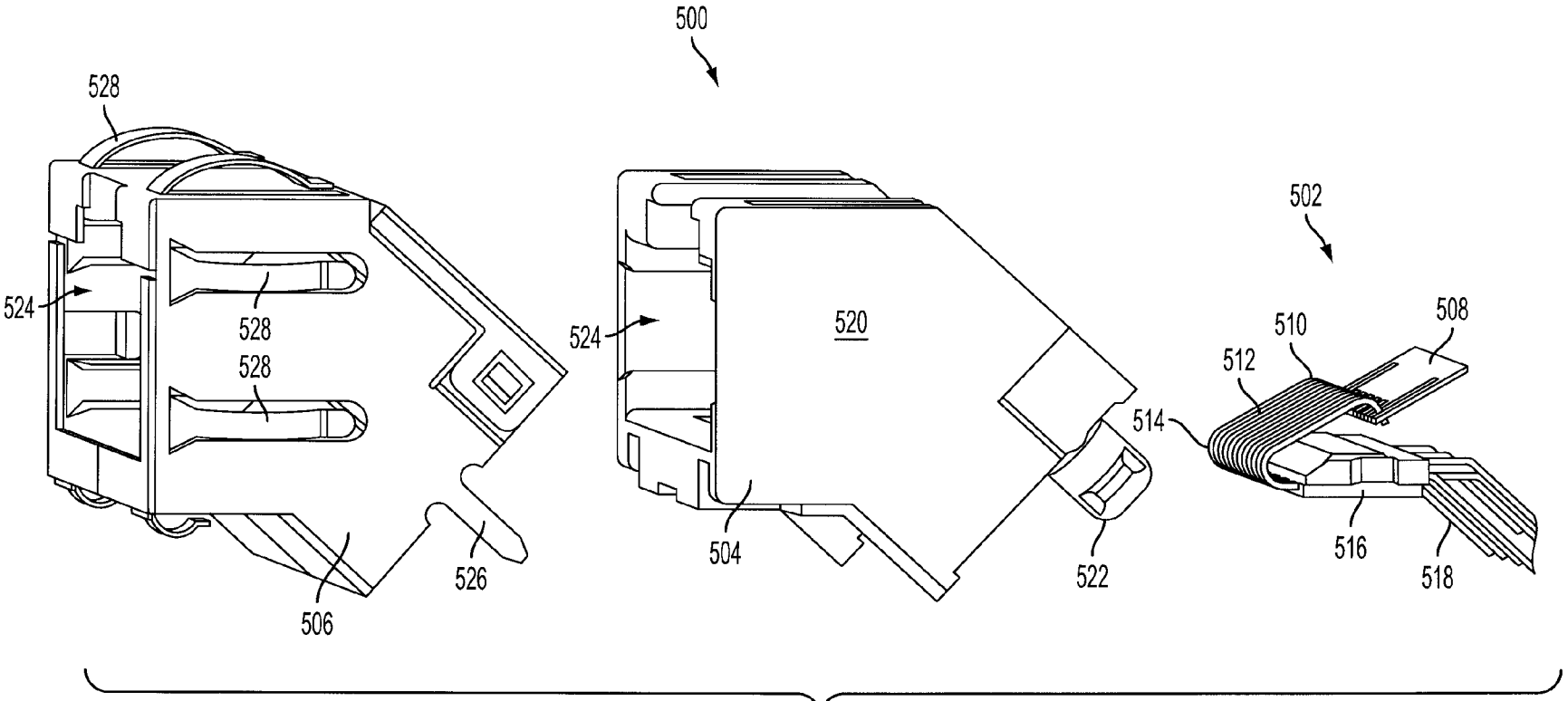
FIG. 38 is a side perspective exploded view of a jack in accordance with an embodiment of the invention.
Figure 39:
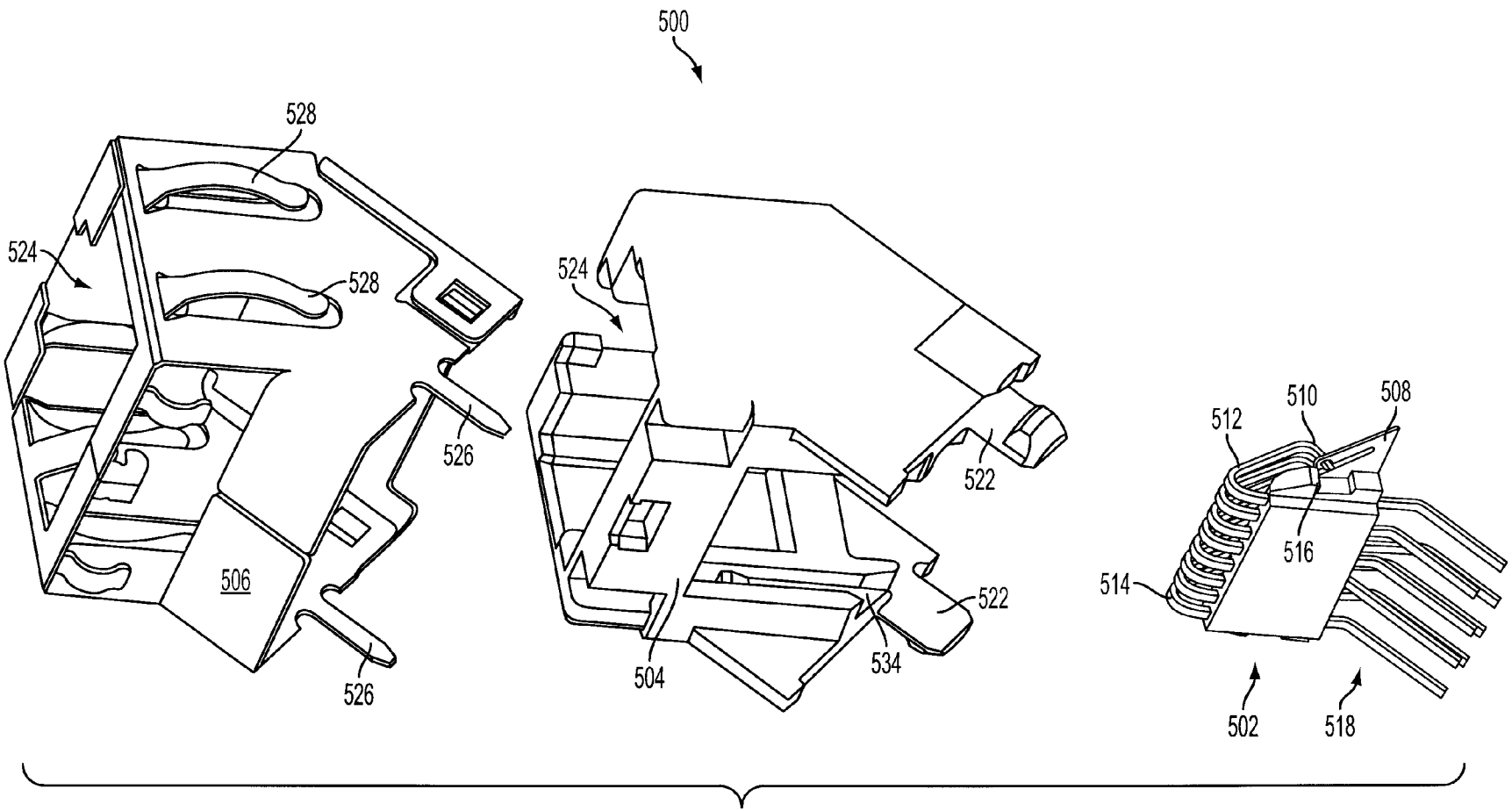
FIG. 39 is a bottom perspective exploded view of a jack in accordance with an embodiment of the invention.
Figure 40:
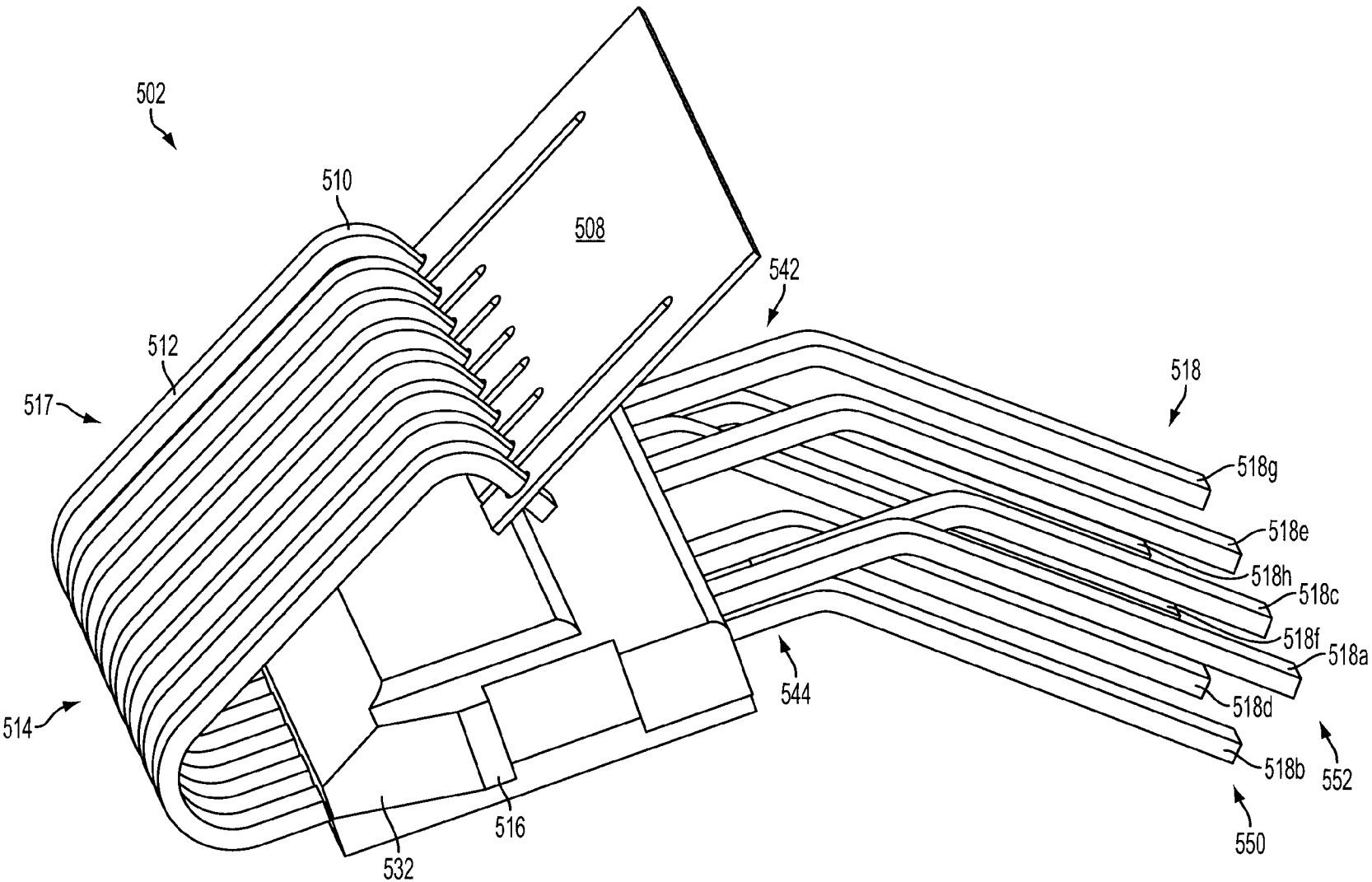
FIG. 40 is a side perspective view of a contact block in accordance with an embodiment of the invention.
Figure 41:
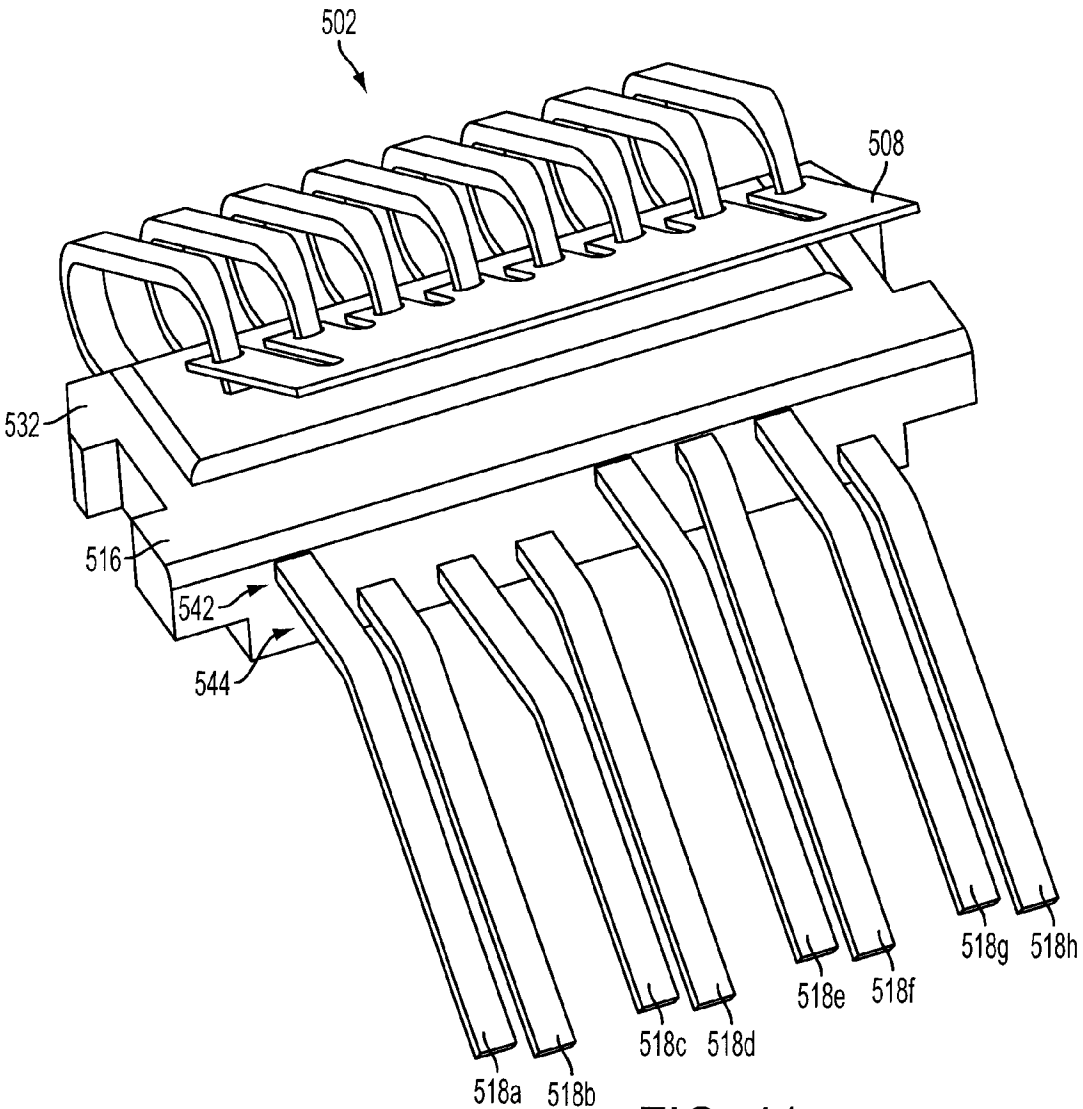
FIG. 41 is a rear perspective view of a contact block in accordance with an embodiment of the invention.

Referring to FIGS. 38 and 39, there is shown a jack 500 in accordance with another embodiment of the invention. Jack 500 may receive plug inserted in a direction oblique to a plane defined by a surface of a circuit board (not shown) where jack 500 is mounted—sometimes referred to as an "angle jack". Jack 500 includes a contact block 502, a housing 504 and a shield 506. Referring also to FIGS. 40 and 41, contact block 502 includes a base plastic member 516 carrying contacts 517 having an arcuate portion 514, a contact portion 512, an end portion 510 and a terminal end 518. Plastic member 516 further includes a tongue 532 (discussed below). End portion 510 is connected to flexible substrate 508 including compensation circuitry as discussed above. Contacts 517 further include terminal ends 518 used in connecting with a circuit board (not shown). Base plastic member 516 may have a central portion cut-out to reduce the dielectric constant of the base plastic member 516 and to improve relevant electrical properties as discussed above or may be solid as shown in the figure.

Housing 504 includes walls 520 defining a plug receiving cavity 524, a mounting post 522 used in mounting jack 500 to a circuit board (not shown), and a groove 524. Shield 506 includes spring members 528, effective to facilitate grounding of jack 500, and spring biased outwardly from a base of shield 506.

Figure 42:
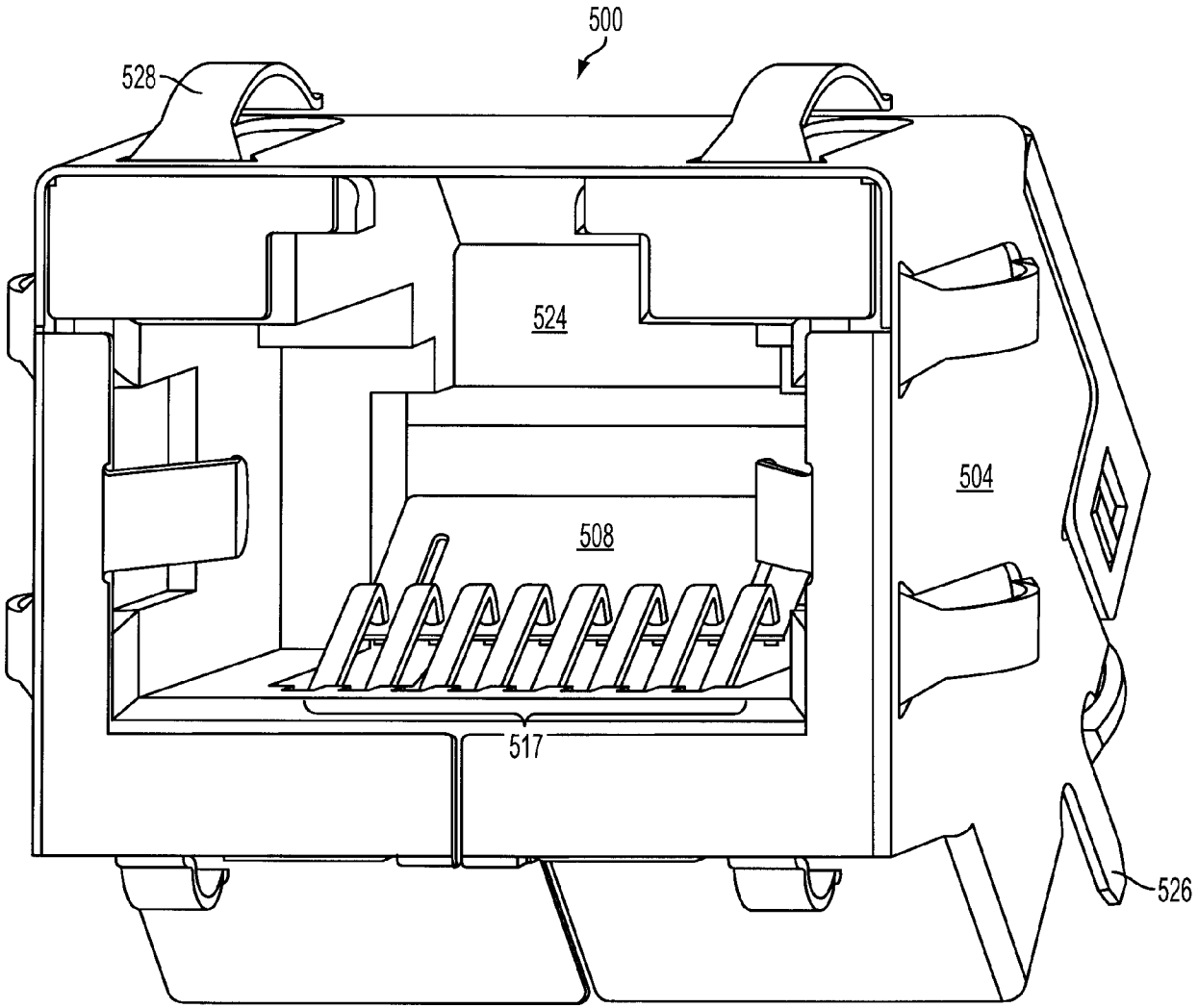
FIG. 42 is a front perspective view of a jack in accordance with an embodiment of the invention.

Referring to FIGS. 38 and 39, to assemble jack 500, a user may slide tongue 532 of contact block 502 into groove 524 of housing 504 and then insert housing 504 into shield 506. An assembled jack 500 is shown in FIG. 42.

As shown most clearly in FIGS. 40 and 41, terminal ends 518 enter base plastic member 516 in a single plane but may move to different planes inside plastic member 516 and exit plastic member 516 in different planes.

Contacts 517 may exit plastic 516 at two planes 544, 542. As shown, terminal ends 518*a*, 518*e*, 518*f*, and 518*g* exit plastic member 516 at first plane 542—which is more toward a top of plastic member 516 than a second plane 542. Conversely, terminal ends 518*b*, 518*c*, 518*d*, and 518*h* exit plastic member 516 at second plane 544 which is more toward a bottom of plastic member 516 than first plane 542.

Terminal ends 518*a*, 518*e*, and 518*g* bend so that terminals ends 518*a*, 518*e*, and 518*g* terminate in a third plane 552 which is more toward a top of plastic member 516 than a fourth plane 550.

Terminal ends 518*b*, 518*d*, and 518*h* bend so that terminal ends 518*b*, 518*d*, and 518*h* terminate in fourth plane 550 which is more toward a bottom of plastic member 516 than third plane 552.

Terminal ends 518*c* and 518*f* cross-over in that they start off in a plane with three terminals and end up in a plane with a different three terminals. Jack 500 may also use the cross-over arrangements discussed above with reference to FIGS. 30-32.

Having described the preferred embodiments of the invention, it should be noted that the scope of the invention is limited only by the scope of the claims attached hereto and obvious modifications may be made without departing from the scope and spirit of the invention.

What is claimed is:

1. A jack comprising:

a housing;

a contact block in the housing, the contact block including a base member and a plurality of elongate contacts carried by the base member, each contact including an elongate straight contact portion structured and arranged to be engaged along its length by a contact of a plug when the plug is inserted into the jack, a first end portion integral with a first end of said contact portion structured and arranged to be attached to an electronic circuit, and a second end portion integral with a second end of said contact portion and constituted by a bend in an end region of said contact portion; and a flexible substrate including a compensation circuit for the jack, said flexible substrate having a plurality of openings formed there-through at an edge region thereof; and wherein said second end portions of said contacts pass through said openings in said flexible substrate to connect said flexible substrate to said contacts, said flexible substrate being otherwise unsupported in said jack.

2. The jack as recited in claim 1, wherein the compensation circuit includes a plurality of capacitors.

3. The jack as recited in claim 2, wherein:

the contact block includes first, second, third, fourth, fifth, sixth, seventh and eighth contacts; and the jack further comprises:

between the third and the fifth contact, a first capacitor with a value in a range from approximately 300 to 3600 fF;

between the fourth and the sixth contact, a second capacitor with a value in arrange from approximately 300 to 3600 fF;

between the first and the third contact, a third capacitor with a value up to 2400 fF;

between the second and the sixth contact, a fourth capacitor with a value up to 2100 fF;

between the third and the seventh contact, a fifth capacitor with a value up to 2100 fF; and between the sixth and the eighth contact, a sixth capacitor with a value up to 2400 fF.

4. The jack as recited in claim 1, wherein at least two of the contacts cross-over inside the base member.

5. The jack as recited in claim 4, wherein the at least two contacts cross-over twice.

6. The jack as recited in claim 1, wherein at least two of the contacts cross-over outside the base member.

7. The jack as recited in claim 1, wherein the at least one contact bends outside the base member.

8. The jack as recited in claim 1, wherein the substrate includes a plurality of separate fingers having edge regions at which said openings are formed.

9. The jack as recited in claim 8, further comprising a rear cover including recesses positioned so as to mate with the at least one contact.

10. The jack as recited in claim 1, wherein:

the contact block includes a tongue; and the housing includes a groove, the groove shaped so as to be able to receive the tongue of the contact block.

11. The jack as recited in claim 1, wherein the contact block further includes walls defining a cut-out portion in a central area of base member.

12. The jack as recited in claim 1, further comprising a shield; and wherein the housing is disposed in the shield.

13. The jack as recited in claim 1, wherein the contacts are all disposed on one side of the housing.

14. The jack as recited in claim 1 wherein said second end portions of said contacts form approximately 90° angles with said elongate straight contact portions of said contacts.

15. The jack as recited in claim 1 wherein said second end portions of said contacts are soldered to said flexible substrate at regions at which said second end portions of said contacts pass through said openings in said flexible substrate.

16. A jack comprising:

a housing;

at least one elongate contact in the housing, each contact including an elongate straight contact portion structured and arranged to be engaged along its length by a contact of a plug when the plug is inserted into the jack, a first end portion integral with a first end of said contact portion structured and arranged to be attached to an electronic circuit, and a second end portion integral with a second end of said contact portion and constituted by a bend in an end region of said contact portion; and a flexible substrate including a compensation circuit for the jack, said flexible substrate having a plurality of openings formed therethrough at an edge region thereof; and wherein said second end portions of said contacts pass through said openings in said flexible substrate to connect said flexible substrate to said contacts, said flexible substrate being otherwise unsupported in said jack.

17. The jack as recited in claim 16, wherein the substrate includes a plurality of separate fingers having edge regions at which said openings are formed.

18. The jack as recited in claim 16, wherein:

the housing includes a base, a pass-through housing disposed on the base and a support cantilevered from the pass-through housing; wherein the at least one contact extends from the contact portion through the support, and through the pass-through housing; and wherein the first end portion extends from the pass-through housing.

19. The jack as recited in claim 18, wherein the at least one contact is a first contact and the jack further comprises at least one second contact disposed on a side of the housing opposite the first contact.

20. The jack as recited in claim 16 wherein said second end portions of said contacts form approximately 90° angles with said elongate straight contact portions of said contacts.

21. The jack as recited in claim 16 wherein said second end portions of said contacts are soldered to said flexible substrate at regions at which said second end portions of said contacts pass through said openings in said flexible substrate.

* * * * *